US006514354B2

(12) United States Patent
Rohrbacher et al.

(10) Patent No.: US 6,514,354 B2
(45) Date of Patent: Feb. 4, 2003

(54) SURFACE CLEANER AND RETRIEVAL UNIT

(75) Inventors: Richard D. Rohrbacher, Phoenix, AZ (US); Timothy P. Stahoviak, Peoria, AZ (US); Jacob M. Sonnett, Phoenix, AZ (US); Ben W. Jentink, Apache Junction, AZ (US); R. Scott Rohrbacher, Glendale, AZ (US)

(73) Assignee: Cyclone Surface Cleaning, Inc., Tempe, AZ (US)

( * ) Notice: Subject to any disclaimer, the term of this patent is extended or adjusted under 35 U.S.C. 154(b) by 0 days.

(21) Appl. No.: 09/885,391

(22) Filed: Jun. 19, 2001

(65) Prior Publication Data

US 2001/0042558 A1 Nov. 22, 2001

Related U.S. Application Data

(60) Continuation-in-part of application No. 09/663,243, filed on Sep. 15, 2000, now Pat. No. 6,302,967, which is a continuation of application No. 08/615,797, filed on Mar. 14, 1996, now abandoned, which is a continuation of application No. 08/343,193, filed on Nov. 22, 1994, now abandoned, which is a division of application No. 08/118,139, filed on Sep. 8, 1993, now Pat. No. 5,500,976.

(51) Int. Cl.[7] ..... B08B 5/04

(52) U.S. Cl. ..... 134/10; 15/321; 15/385; 134/6; 134/21; 134/34; 134/42; 134/179; 239/7; 239/251; 239/262; 239/754; 510/214; 510/215; 510/217

(58) Field of Search ..... 15/321, 385; 134/6, 134/10, 21, 34, 42, 179; 239/7, 251, 262, 754; 510/214, 215, 217

(56) References Cited

U.S. PATENT DOCUMENTS 5,265,805 A * 11/1993 Artenian ..... 134/176
5,500,976 A * 3/1996 Rohrbacher et al. ..... 15/320
5,501,396 A * 3/1996 Rohrbacher et al. ..... 239/259
5,601,659 A * 2/1997 Rohrbacher ..... 134/10
5,718,015 A * 2/1998 Rohrbacher ..... 15/321
5,826,298 A * 10/1998 Rohrbacher et al. ..... 15/321
6,302,967 B1 * 10/2001 Rohrbacher et al. ..... 134/10

FOREIGN PATENT DOCUMENTS

WO WO98/00239 * 1/1998

* cited by examiner

*Primary Examiner*—Sharidan Carrillo
(74) *Attorney, Agent, or Firm*—Brinks Hofer Gilson & Lione

(57) ABSTRACT

This invention is directed to a cyclonic power system and method of using the system to clean flat surfaces. The cyclone power system includes a driven spindle that is mounted for rotation about its longitudinal axis. There are a plurality of radially extending straight rod extending from the spindle. Curved blades are connected at one end to the spindle and at their other end to the free end of a straight rod. The centrifugal force, generated as a result of the rotation of the driven spindle is not effective to cause the straight rods, which are constructed of stainless steel, to lengthen and since the curved blades are connected to the straight rods, the centrifugal force is not effective to lengthen the curved blades. In an embodiment of the invention a perforated disc is secured to the bottom surface of the spindle and to the free ends of the straight rods. In this embodiment the water and debris is pulled up through the perforations in the disc. The perforated disc protects the rotary member from heavy projectiles that are lifted from the surface to be cleaned, adds to the stability to the rotary member and has eliminated of the need for the supports extending between the mid-portion of the curved blades and the straight rods. In addition to the above improvements the flow through the perforations in the disc is limited to the upward flow and once water laden with debris has passed through the perforations in the disc it remains above the disc and is swept to the discharge.

40 Claims, 12 Drawing Sheets

SURFACE CLEANER AND RETRIEVAL UNIT

RELATED APPLICATIONS

This application is a continuation-in-part application of U.S. application Ser. No. 09/663,243 filed Sep. 15, 2000 now U.S. Pat. No. 6,302,967, which is a continuation of application Ser. No. 08/615,797 filed Mar. 14, 1996, now abandoned, which is a continuation of U.S. application Ser. No. 08/343,193 filed Nov. 22, 1994, now abandoned, which is a divisional application of U.S. application Ser. No. 08/118,139 filed Sep. 8, 1993, now U.S. Pat. No. 5,500,976.

BACKGROUND OF THE INVENTION

1. Field of the Invention

2. Discussion of Background and Prior Art

U.S. Pat. No. 5,500,976, and its divisional applications, disclosed a mobile cyclonic power wash machine that includes a water reclamation system and a rotary union that functions and has the structural integrity to survive in the operating environment of this machine. This machine operates at a rotary speed of about 2,000 rpm and water pressure of about 4,500 psi. Prior to the introduction of machines of the type disclosed in U.S. Pat. No. 5,500,976 ("the '976 patent"), water dispensing cyclone surface cleaning machines operated at slower revolutionary speeds and lower pressures. The '976 patent includes a vacuum system carried by the component carrying vehicle that functioned to retrieve water that had been sprayed on the surface to be cleaned along with debris from the surface. The vacuum retrieval system of this machine was satisfactory, however, it has low efficiency and does not retrieve all the water that is dispensed. Also, this machine was susceptible to damage from heavy retrieved objects such as stones and bolts.

The component carrying vehicle of the '976 patent carried a water storage means for holding the water to be used for cleaning, a water pumping system for pumping and pressurizing the water from the storage means and a water heater for heating the water. Water from this storage means is pumped under pressure to the cyclone sprayer which sprayed the water onto the surface to be sprayed. The cyclone sprayer includes a mobile base and a handle to allow an operator to move the sprayer over the surface to be cleaned. The water and debris that is picked up by the vacuum retrieval system is directed to a water reclamation system that is carried by the component carrying vehicle. The water reclamation system included a filtration tank to which the vacuum source was connected. The filtration tank included a downward sloping receiving trough for catching large debris. At the lower end of the downward sloping trough, there is a screen through which the liquid passes into a settling tank that includes a series of cascading chambers. The water successively fills each chamber and then flows over to the next adjacent chamber, such that some debris and particles present in the water are deposited in the chamber and cleaner water is passed to the next chamber. The cleaned water from the last chamber is then transported to the water storage means where it is available for reuse by the cyclone sprayer.

The '976 patent is hereby incorporated by reference as a part of this application.

U.S. Pat. No. 5,501,396 ("the '396 patent"), which is a divisional application of the '976 patent, discloses a rotary union through which water under high pressure can flow for sustained periods from a non-rotating conduit to a conduit rotating at high speed without developing leaks.

U.S. Pat. Nos. 5,601,659 and 5,718,015 disclose a method and apparatus for use with the machine of the type disclosed in the '976 patent of placing a polypropylene filled bag in the chamber of the cascading settling tank for absorbing hydrocarbons suspended in or floating on the reclaimed water.

U.S. Pat. No. 5,826,298 ("the '298 patent"), which issued on Oct. 27, 1998, discloses an improvement to the machine disclosed in the '976 patent. The '298 patent has replaced the vacuum system that retrieved water and debris with a power driven retrieval rotor having curved blades that functions as a fan to pick-up the water sprayed to the surface to be cleaned along with the debris from the surface being cleaned. The retrieved water is collected in a tank carried by the cyclone sprayer and a positive displacement pump, carried by the cyclone sprayer, functions to convey the retrieved material to the reclamation system carried by the component carrying vehicle. In the machine disclosed in the '298 patent, centrifugal force developed by the high rotating speeds causes the curved blades to straighten and thus elongate. This causes the free ends of the blades to interfere with the disk-shaped shroud. Also, the curved blades were susceptible to damage by heavy debris, such as rocks and bolts, that was picked up by the driven rotor.

The '298 patent is hereby incorporated by reference as a part of this application.

SUMMARY OF THE INVENTION

This application relates to a power wash and reclamation machine for cleaning flat surfaces. High pressure water is directed at the surface to be cleaned from nozzles located at the periphery of a rotating pick-up member that is mounted for rotation centrally of a disc-shaped housing of the cyclone sprayer. The periphery of the disc-shaped housing is formed with an annular channel. The cyclone sprayer includes a spindle formed from stainless steel that is mounted for rotation about its longitudinal axis centrally thereof. A driven portion of the spindle extends through the disc-shaped housing such that it is located externally of and above the housing. A longitudinally extending bore is formed in the spindle from its upper driven portion toward its lower portion along the spindle's longitudinal axis. This longitudinally extending bore does not extend through the bottom end of the spindle. A power source is connected to the driven portion to rotate the spindle relative to the housing. The spindle includes a hub contained within the housing that is located at the lower portion of the spindle. There are a plurality of radially extending bores normal to the spindle's longitudinal axis formed in the hub. Some of these radially extending bores intersect with and open into the longitudinally extending bore of the spindle. The remainder of the radially extending bores stop short of the longitudinally extending bore and, thus, there is no fluid communication between these bores and the longitudinally extending bore. A straight rod is received in each of the radially extending bores, extends outwardly and terminates in the annular channel formed in the periphery of the housing. Curved blades are connected to the spindle hub and to the free end of a straight rod. The outer ends of the curved blades are shaped to closely fit into the annular channel formed in the housing. In a first embodiment, braces are provided at the mid-points of the curved blades that connect to the associated straight rod. The centrifugal force, generated as a result of the rotation of the rotating pick-up member, is not effective to cause the straight rods, which are constructed of stainless steel, to lengthen and, since the curved blades are connected to the straight rods, the centrifugal force is not effective to lengthen the curved blades.

As a result, the expansion of the curved blades such that they would interfere with the peripheral edge of the housing has been eliminated.

In a second embodiment of Applicants' invention, a perforated disc has been secured to the bottom surface of the spindle and to the free ends of the straight rods. The curved blades of the driven rotary member create a tremendous suction that lifts the water and debris from the surface to be cleaned. It was found that objects as large and heavy as man-hole covers were being lifted and colliding with the rotary member. This often damaged the rotary member and required repairs to maintain the efficiency of the system. In this embodiment, since the curved blades are located above the perforated disc, the water and debris is pulled up through the perforations in the disc. The disc is provided with openings that are aligned with the nozzles to permit the uninterrupted flow of water from the nozzles to the surface to be cleaned. The perforated disc was added to protect the rotary member from heavy projectiles that are lifted from the surface to be cleaned, and has succeeded in this intended function. However, in addition, the disc has added greatly to the stability to the rotary member and has eliminated the need for the supports extending between the mid-portion of the curved blades and the straight rods. In this embodiment, all rotary pick-up connections are made through screw threads and welded connections have been completely eliminated. This embodiment has greatly facilitated maintenance of the rotary pick-up member since there are now fewer parts and, as a result, disassembly and assembly can be done with simple tools and only damaged parts need be replaced.

In addition to the above improvements that are attributable to the perforated disc, a new and completely unexpected result has also been found. Without the rotary disc, some of the water and debris that was lifted by the rotary member was deflected back to the surface being cleaned. Some of the deflected material would be picked up a second time or multiple times, and some would be left on the surface that was being cleaned as the cyclone sprayer advances to new areas of the surface being cleaned. It has been found that the flow through the perforations in the disc is limited to the upward flow and once water ladened with debris has passed through the perforations in the disc, it remains above the disc and is swept to the discharge. The phenomena of the retrieved materials remaining above the perforated disc is a result of material that is deflected downwardly toward the perforated areas of the disc being deflected by the stream of material flowing upward through the perforated openings of the disc and causing it to impinge on the solid areas of the perforated disc. This deflected material then joins with deflected material that would have impinged on the non-perforated areas of the disc. The sum of this deflected material is decelerated as a result of being deflected and joins the centrifugal flow of material created by the curved blades of the rotary member. As a result, the percent of the water sprayed to the surface that is recovered is increased substantially and the efficiency of the rotary member with the perforated disc is considerably greater than a rotary member without the perforated disc.

In a third embodiment of Applicants' invention, the perforated disc and the rotary curved blades have been cast as an integral unit. This embodiment enables a damaged rotor to be replaced at a worksite quickly and expediently by the operators of the equipment. This in the field repair entails nothing more than removing a single element and replacing the removed element with a spare unit that is carried with the equipment to the worksite. This is extremely important for the type of work that is performed with this equipment. Most clean up projects are performed when the area to be cleaned is either shut down for the clean up project or during off or non-working periods. It is important that the clean up project be completed in minimum times or by a specific time. As a result, long down periods for repairs cannot be tolerated and must be performed by the personnel who are operating the equipment. With this invention, a personnel operating the equipment in the field can make the repair in the field by simply removing and replacing the single unit cast rotor and disc 200.

Applicants have found that, in the embodiments of this invention, in which a perforated disc is used, that the size, shape and pattern of the perforations are important. Applicants have used perforations that are shaped as circles and as slots. The slots are orientated such that they extend generally concentric to the center of the disc. The liquid flowing along the upper surface of the disc is flowing in a generally radial direction from the center of the disc toward the periphery. Thus, this orientation of the disc has the liquid flowing across the width of the slots rather than longitudinally of the slots. Applicants have found that half inch circles and slots having a half inch width perform excellent in most situations. However, when cleaning runways, the half inch perforations get plugged by crumb rubber balls picked up from the runway. This has been eliminated by increasing the diameter of the circular perforations and the width of the slots to one inch. The unexpected advantage of retaining a greater percentage of the liquid that is picked up has been retained and the plugging problem has been eliminated.

This invention has been found to be very useful around airports. In the loading and unloading areas, there is often oil and fuel, and other debris, including nuts and bolts spilled on the tarmac. It is important for the safety of the airport personnel, as well as passengers as they embark and egress aircraft, that these areas of the airport be maintained in a clean and sanitary condition. It is also important that the runways be cleaned to avoid dangerous situations. When an aircraft touches down for a landing, the tires must instantly begin turning at a peripheral speed equal to the speed of the aircraft. While the tires are accelerating to reach this speed, they leave rubber deposits on the pavement much the same as a race car under extreme acceleration. Over time, this deposit build-up becomes very thick and, when wet, a dangerous situation exists. Airports must maintain a friction level on runways that will insure safe and skid-free landings regardless of the weather conditions. This rubber debris is called crumb rubber and, under some conditions, forms into small balls about the size of a marble. In a recent runway cleaning project, 55 gallon drums of crumb rubber weighing 6,500 pounds was collected from the runways.

A further use of Applicants' reclamation machine is for recovering liquid that was not deposited by Applicants' machine. One application of this use is to recover liquid that has been used to de-ice aircraft, such as ethylene glycol. This liquid is toxic and it is unlawful to permit it to drain into the sewer systems. Applicants' machine has the capacity to pick-up the de-icing liquid quickly before it can drain to the sewer system. Another application of this use is to pick-up the standing water on athletic fields, such as football and baseball fields.

DETAILED DESCRIPTION OF THE INVENTION

Figure 1:
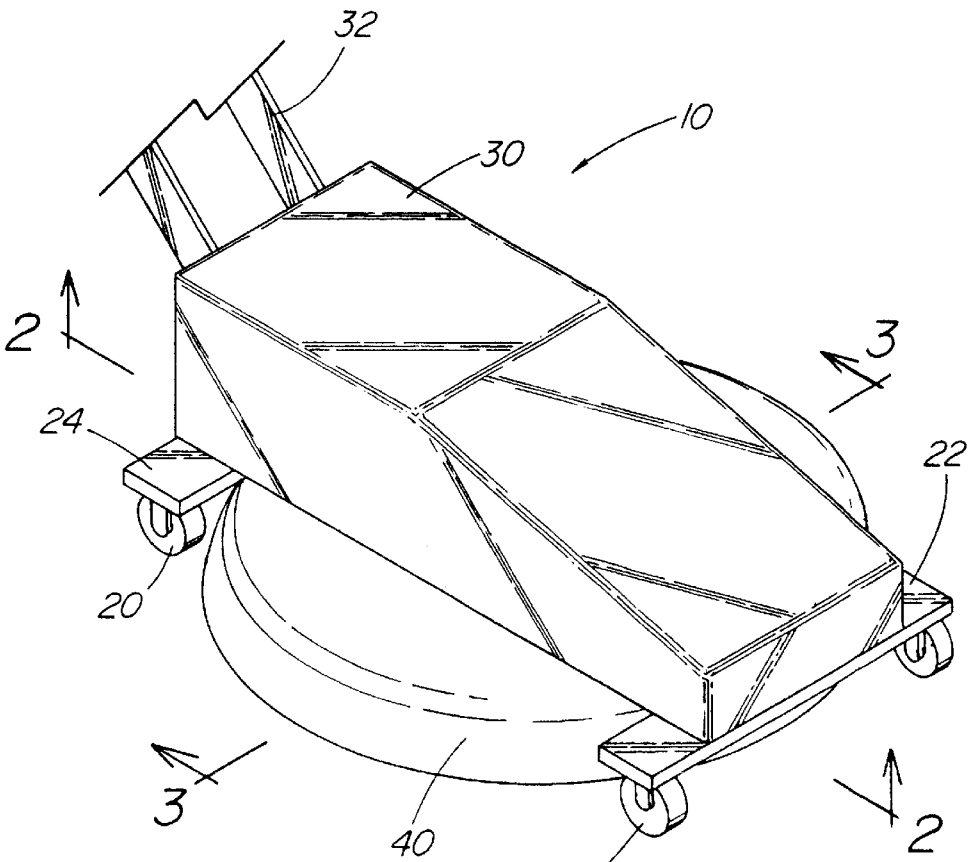
FIG. 1 is a perspective view of an embodiment of the power wash and the reclamation machine.

FIG. 1 is a perspective view of the power wash and reclamation machine 10. As seen in this view, the machine 10 is supported on four ground engaging caster wheels 20. The caster wheels 20 are secured to the ends of forward frame members 22 and rearward frame members 24. A pair of fore and aft extending channel members 26, see FIGS. 1A, 2 and 3, interconnect the frame members 22 and 24. In FIG. 1, a cowling 30 is carried on the top surface of frame members 22 and 24 and encases the channel members 26, as well as the machine's drive mechanism. The cowling 30 is releasably connected to the channel members 26 and/or the frame members 22, 24.

A generally disc-shaped housing 40 is carried by and extends downwardly from the channel members 26. Portions of a handle 32 are shown in FIG. 1 which are provided for use with the walk behind embodiment of the machine.

Figure 1A:
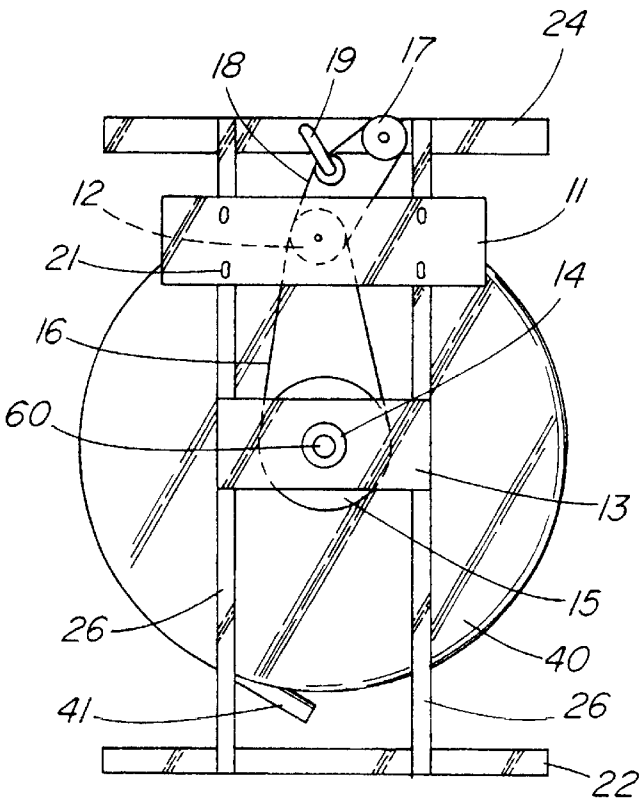
FIG. 1A is a plan view of the reclamation machine.
Figure 2:
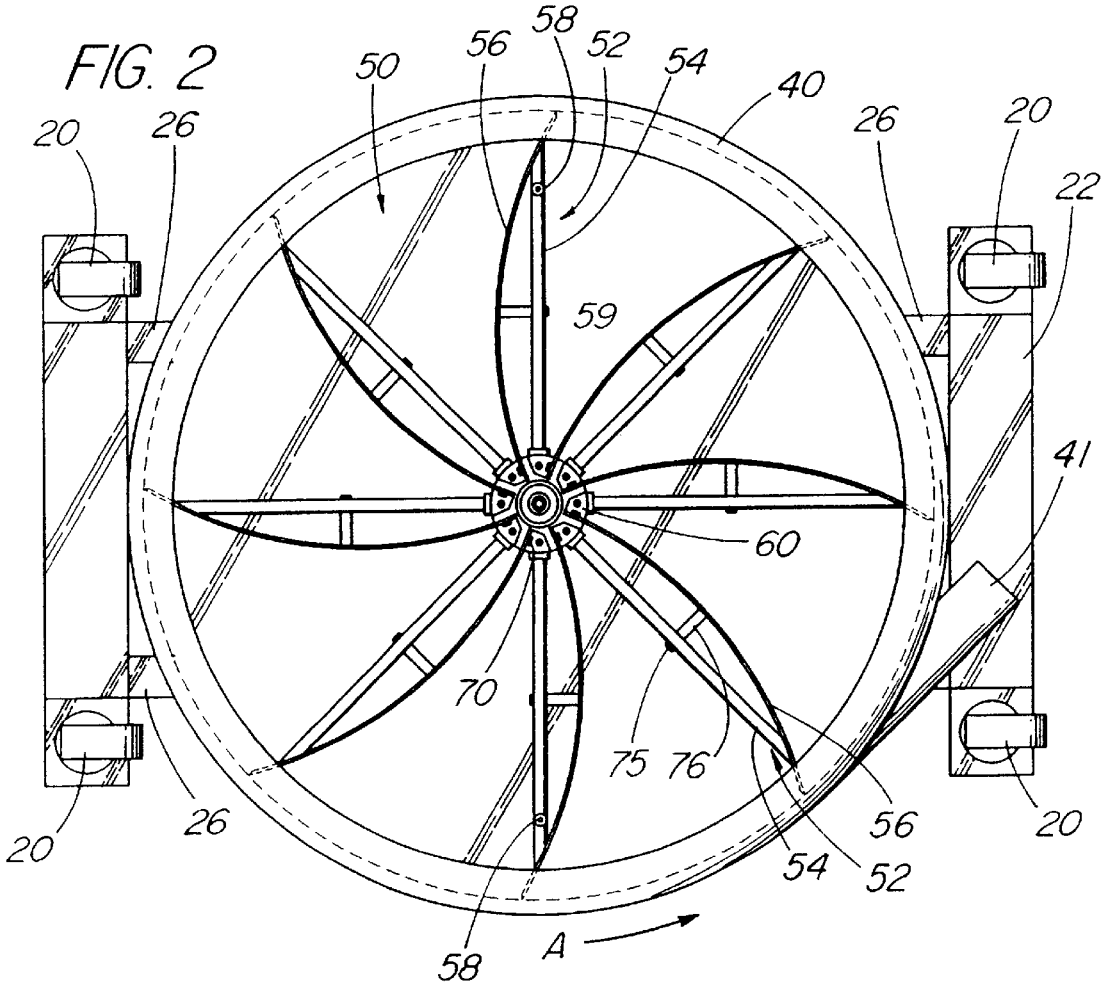
FIG. 2 is a bottom view of the power wash and reclamation machine.
Figure 3:
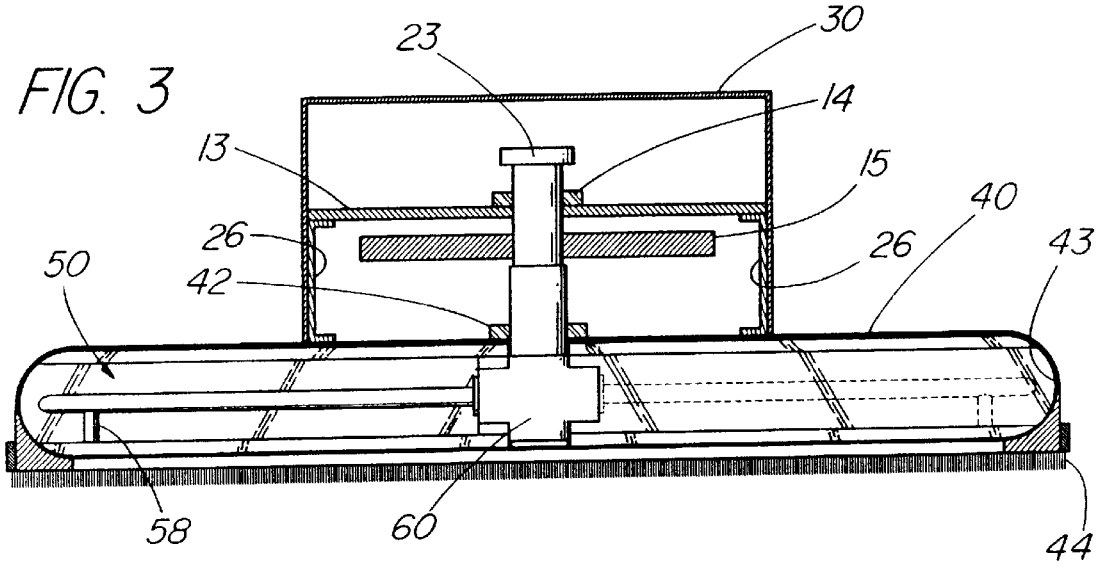
FIG. 3 is a cross-sectional view of the power wash and reclamation machine taken along lines 3—3 of FIG. 1.
Figure 9:
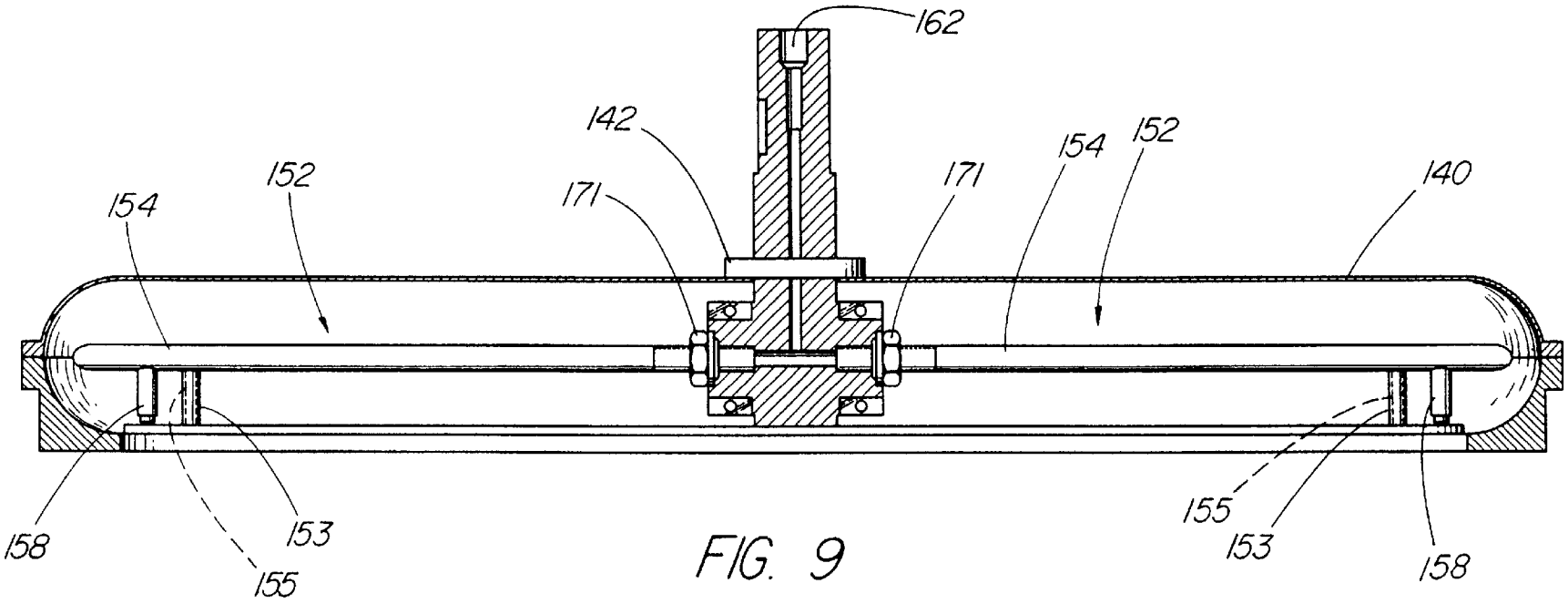
FIG. 9 is a cross-sectional view of a second embodiment of the power wash and reclamation machine that is similar to FIG. 3.
Figure 11:
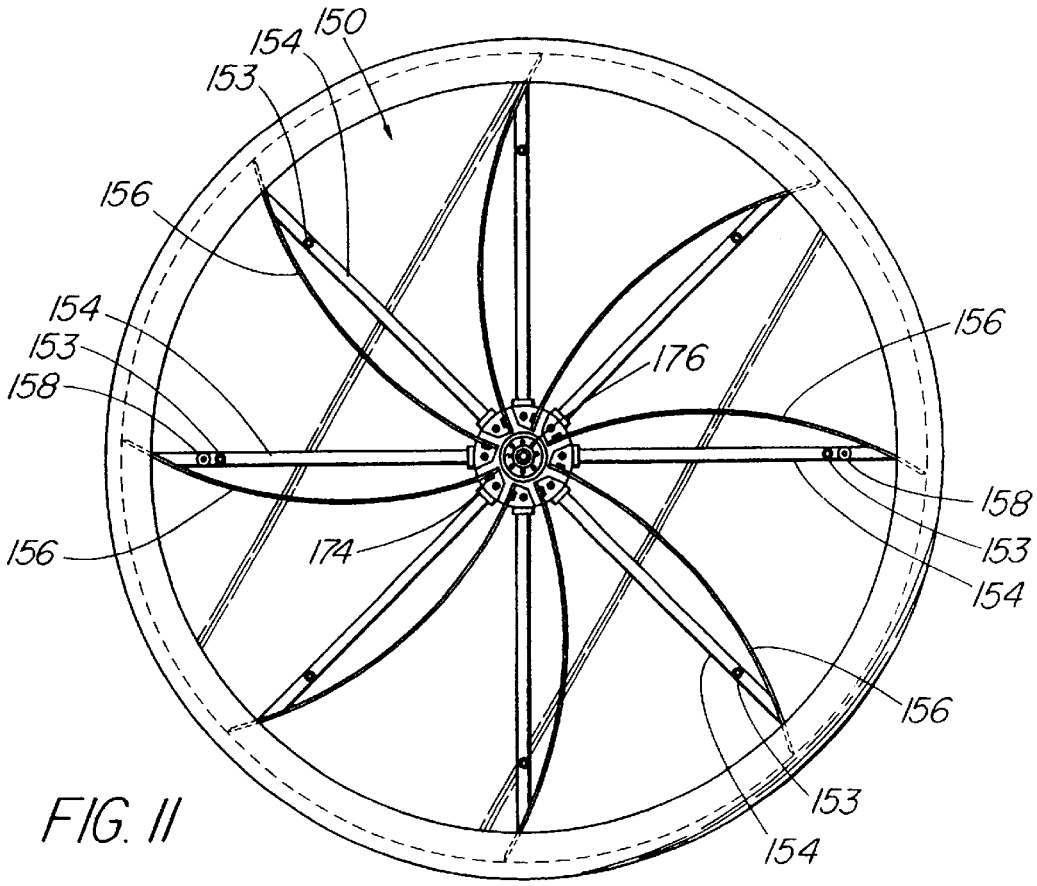
FIG. 11 is a bottom view of the power wash and reclamation machine shown in FIG. 9 with the perforated disc removed.

FIG. 1A is a plan view of reclamation machine 10 with the cowling 30 removed. An engine or power source 11 is mounted on the channel members 26 through elongated slots 21 which enables the tension on the drive belt 16 to be adjusted. The engine 11 can be a gas internal combustion engine, a hydraulic motor, an electric motor or an air motor. A double drive pulley 12 is carried by the engine output shaft. One groove of the double drive pulley 12 receives the spindle drive belt 16 and the other groove receives the water pump drive belt 18. A top bearing plate 13 extends transverse to and is secured to the channel members 26. A top bearing 14 is mounted on the bearing plate 13 and receives the upper portion of spindle 60. As can be seen in FIGS. 3 and 9, lower spindle bearings 42 and 142 are secured to the upper outside surface of the disc-shaped housings 40 and 140 that receive a lower portion of spindles 60 and 160. A drive pulley 15 is keyed to the spindle between the upper and lower bearings. The drive pulley 15, carried by spindle 60, 160, receives the spindle drive belt 16 which is driven by the drive pulley 12. Tension on drive belt 16 can be adjusted by adjusting the position of the engine 11 through the engine adjustment slots 21. The rotating pick-up members 50 and 150, see FIGS. 2, 3 and 11, are carried by the driven spindles 60, 160 that cause the recovered material to be discharged through discharge 41. A water pump 17 is mounted on the rear frame member 24 that functions to pump the water and refuse that has been recovered by the reclamation machine 10 to the water reclamation system that is carried by the component carrying vehicle. A pump drive belt 18 is driven by the engine drive pulley 12 and provides rotary drive to the water pump 17. A belt tensioning mechanism 19 is provided to adjust the tension in pump drive belt 18. Not shown in this application but fully disclosed in the previously identified U.S. Pat. No. 5,826,298, is a tank carried by the cyclone sprayer that receives the reclaimed material from discharge 41. A removable screen is supported within the tank below the discharge from discharge 41. Large debris is collected on the upper surface of the removable screen and the remaining liquid and collected matter passes through the screen. Thus, the screen functions to remove large debris, such as nuts, bolts or nails, that could damage the pump 17 or other downstream mechanisms. The tank includes a sump pump that collects the filtered liquid and material which is discharged to the water reclamation system through a conduit that is connected to pump 17.

Figure 27:
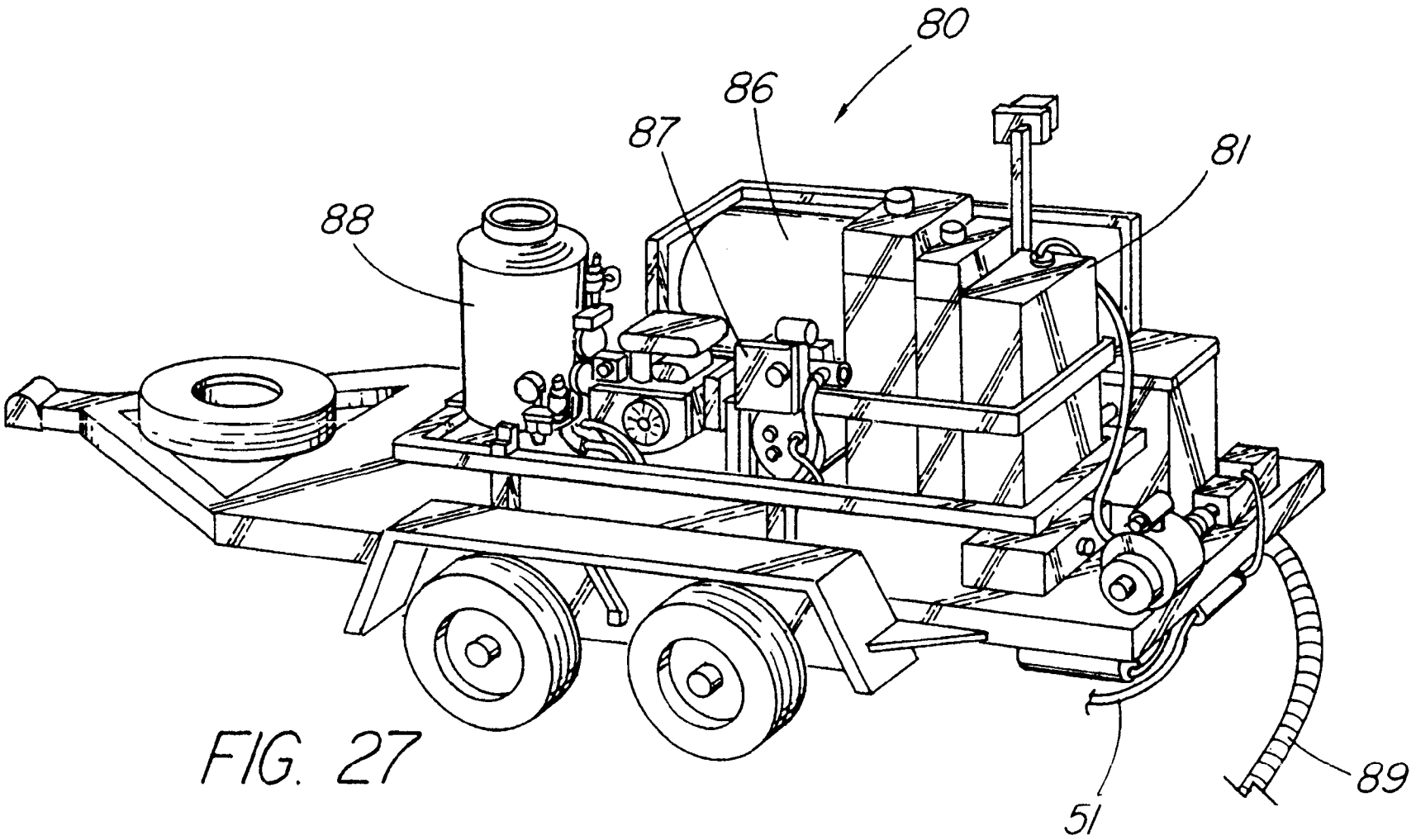
FIG. 27 is a perspective view of the stationary unit.

FIG. 27 shows a stationary unit 80 that is used to cooperate and support the power wash and reclamation machine 10. The stationary unit 80 has a receiving and recycling facility 81 that is connected to the power wash and reclamation machine 10 by a flexible conduit 89. The flexible conduit 89 is connected to the discharge 41 (see FIG. 1A) of the power wash and reclamation machine 10. Water and debris is conveyed from the power wash and reclamation machine 10 through the flexible conduit 89 to the receiving and recycling facility 81. The recycled water is transferred from the receiving and recycling facility 81 to the water storage unit 86 that is also carried by the stationary unit 80. Water from the water storage unit 86 is pressurized by a pump 87 and conveyed through a flexible conduit 51 to the rotary union 23 (see FIG. 3) of the power wash and reclamation machine 10. A water heater 88 is carried by the stationary unit 80 and can be used to heat the water prior to it being conveyed through flexible conduit 51 to the power wash and reclamation machine 10.

FIG. 2 is a bottom view of the power wash and reclamation machine. The caster wheels 20, forward and rearward frame members 22, 24, channel members 26 and disc-shaped housing 40 are all visible in this view. The cowling 30 has not been shown in this view. The rotating pick-up member 50, rotates in the direction indicated by arrow A, causing the retrieved material to be discharged through discharge member 41. The rotating pick-up member 50 includes a spindle 60 that is formed from stainless steel and is mounted for rotation on the disc-shaped housing 40 about the spindle's longitudinal axis X—X. In the embodiment shown in FIG. 2, there are eight arms 52 carried by and extending outwardly from the spindle 60. Each arm 52 includes a straight rod 54 that is secured to spindle 60 and extends normal to the longitudinal axis of the spindle and a curved blade 56. The curved blades 56 are secured at one end to the spindle 60 and at their other end and centrally thereof to its associated straight rod 54.

Figure 4:
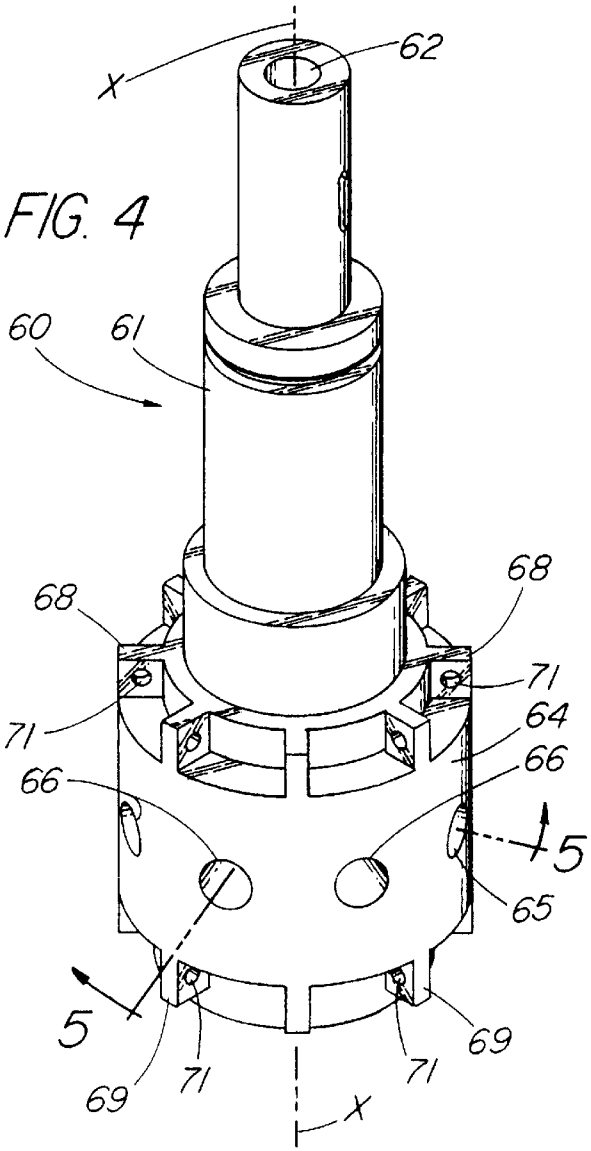
FIG. 4 is a perspective view of the spindle.

As best seen in FIG. 2, there are nozzles 58 on the free ends of two of the straight rods 54. The two straight rods 54 that carry the nozzles 58 are hollow and are in fluid communication with a central or longitudinal bore 62 (see FIGS. 4 and 5) formed in the spindle. The free ends of the straight rods that carry the nozzles 58 are plugged. As shall be discussed in greater detail, water under high pressure flows through bore 62 in spindle 60 and the hollow straight rods 54 that carry the nozzles 58, and is dispensed toward the ground through nozzles 58. The straight rods 54 for the arms 52 that do not carry nozzles 56 could be hollow, but they need not be. The free ends of the straight rods 54 are formed such that they fit flush against the concave surface of the associated curved blades 56.

The stainless steel spindle 60 of the rotating pick-up member 50 is mounted for rotation in bearing 42, about its longitudinal axis X—X, centrally of the housing 40. As best seen in FIG. 3, a lower bearing 42 is carried by the housing 40 which, in the preferred embodiment, is connected to housing 40 by countersunk bolts. As seen in FIGS. 1A and 3, spindle 60 is also carried by an upper bearing 14 that is secured to the upper bearing plate 13. A driven portion 61 of the spindle 60 extends upwardly through the housing 40 such that it is located externally of and above the housing 40. A longitudinally extending bore 62 is formed in the spindle from its upper driven end toward its lower portion along the spindle's longitudinal axis X—X. This longitudinally extending bore 62 does not open through the bottom end of the spindle 60. A power source 11 is connected to the driven portion to rotate the spindle relative to the housing.

A rotary union 23 is connected to the uppermost portion of the spindle 60. The rotary union 23 is connected to the source of water that is to be dispensed through the nozzles 58. The source of the water is not rotating and the spindle 60 is rotating at a high speed. Also, the water is at high pressure and can be at an elevated temperature. The rotary union 23 must have the capability to allow water at high pressure and temperature to flow from the non-rotating source to the spindle that is rotating at high speeds. Reference is hereby made to the '396 patent that discloses a rotary union of this type. The '396 patent is hereby included by reference as a part of this disclosure, A brush seal 44 is shown in FIG. 3 that is secured to the housing 40 along its lower edge. Seal 44 functions to curtail the flow of air from outside the housing 40 into the interior of housing 40. This allows a vacuum to be created within the hollow of housing 40 which enhances the ability of the system to pick up debris that lies in housing 40. The brush seal 44 accommodates unevenness in the surface being cleaned. It should be noted that, although seal 44 is not shown in FIG. 1, Applicants' preferred embodiment includes this feature.

Figure 5:
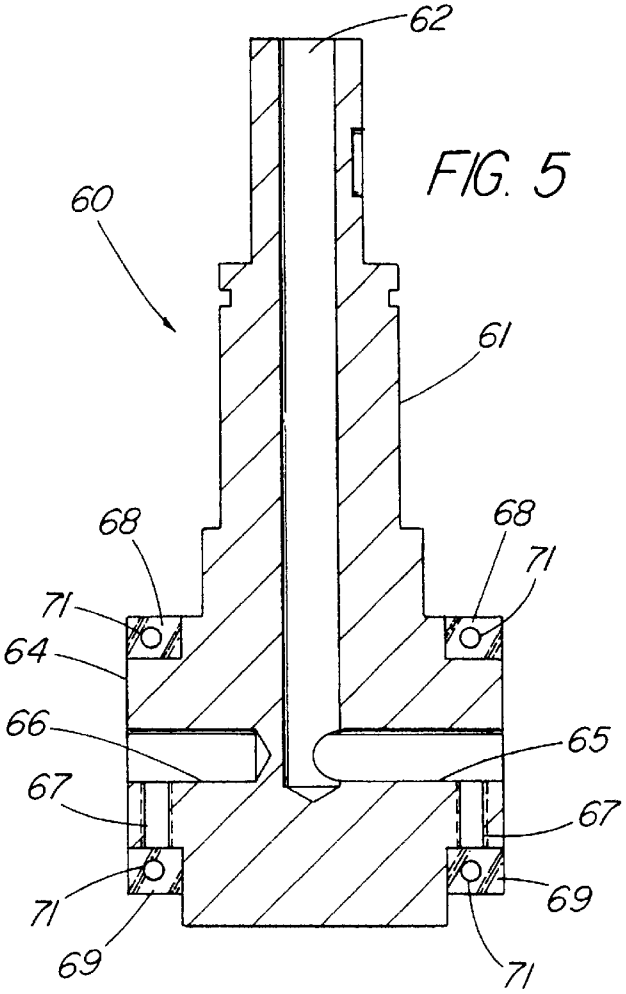
FIG. 5 is a cross-sectional view of the spindle taken along lines 5—5 of FIG. 4.

The spindle includes a hub 64 that is located at the lower portion of the spindle contained within the housing 40. There are a plurality of radially extending bores 65, 66 that are normal to the spindle's longitudinal axis X—X, formed in the hub 64. As best seen in FIG. 5, a cross-sectional view of the spindle, taken along lines 5—5 of FIG. 4, some of the radially extending bores 65 intersect with and communicate with the longitudinally extending bore 62. Also, as best seen in FIG. 5, the remainder of the radially extending bores 66 stop short of the longitudinally extending bore 62 and, thus, there is no communication between these bores 66 and longitudinally extending bore 62. The straight rods 54 that carry the nozzles 58 are inserted into the bores 65 such that the hollow rods 54 are in fluid communication with a central bore 62 formed in the spindle 60. As a result, water, under high pressure, flows through bore 62 into the hollow straight rods 54 and is discharged through the nozzles 58. The straight rods 54 that do not carry nozzles 58 are inserted in the bores 66 which are not in fluid communication with the spindle bore 62. All of the straight rods 54 are releasably secured in the bores 65 and 66 by set screws 59 that are received in apertures 67 formed in the hub 64 of the spindle 60.

The spindle 60 has an upper flange 68 and a lower flange 69 for each of the arms 52. As shall be further discussed, fastening means 70, such as nuts and bolts, secure the curved blades 56 to the hub 64 of the spindle 60 through holes 71 formed in flanges 68 and 69.

Figure 6:
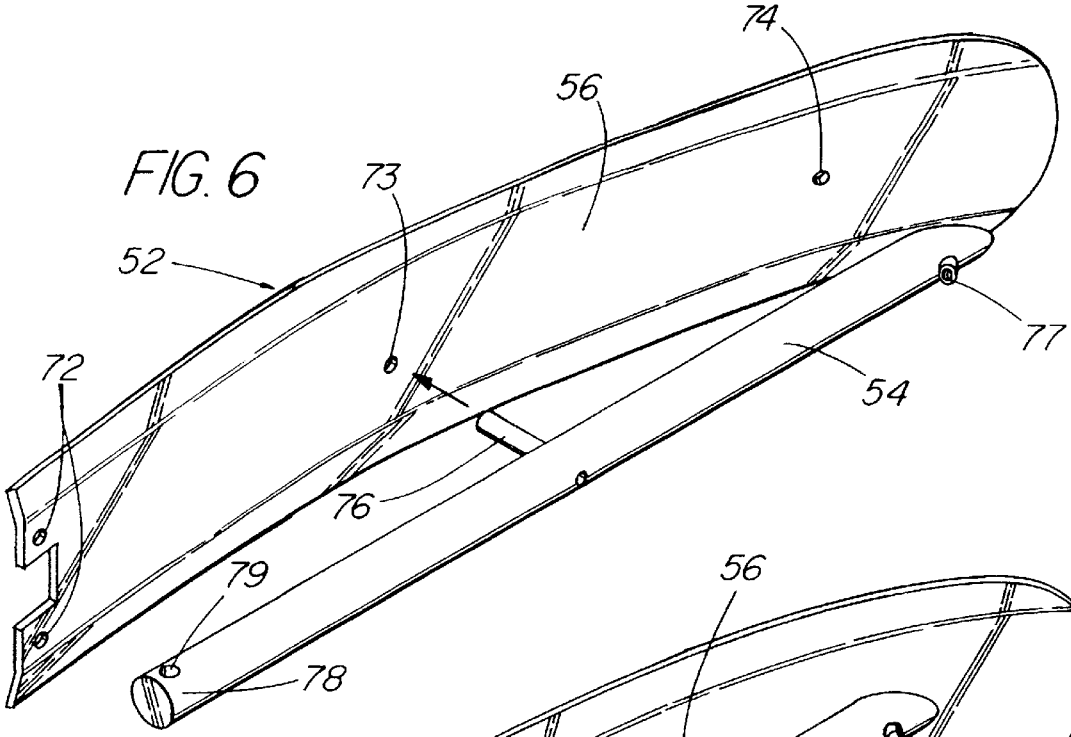
FIG. 6 is an isolated exploded view of one of the arms.

FIG. 6 is an exploded view of one of the arms 52 as seen from the back. As the rotary pick-up member 50 rotates, the surface of the curved blade 56, seen in this view, is the trailing surface and the surface not seen is the leading surface. A pair of apertures 72 are formed in the central end of the curved blade that align with the holes 71 formed in flanges 68 and 69. Fastening means 70 pass through the aligned apertures and holes to thus secure the curved blade to the spindle 60. A central aperture 73 and a free end aperture 74 are formed in the curved blade for the purpose of connecting the curved blade to the straight rod 54. A fastening means, 75 such as nuts and bolts, pass through apertures 73 and 74 to secure the curved blade 56 to the straight rod 54.

At the central portion of the straight rod 54, a hole is bored and a hollow tube 76 that extends through the bore is welded to the straight rod 54. The free end of the straight rod 54 is machined on one side such that it fits flush with the curved surface of the curved blade 56. A hole is bored in the free end of the straight rod 54 and a hollow tube 77 is welded to the straight rod 54. The end of the hollow tube 77 that abuts the curved surface of the curved blade 56 is machined to fit flush against the blade's curved surface. The fastening means 75 extends through hollow tubes 76 and 77 and the aligned apertures 73, 74 to thus secure the curved blade 56 to the straight rod 54. The central end 78 of the straight rod is inserted in bore 66 formed in the hub 64 of the spindle 60. A hole 79 is formed in the central end 78 of the straight rod that aligns with the tapped apertures 67 formed in the hub 64 of the spindle. A set screw 59, that is received in the tapped apertures 67, extends through the hole 79 to positively lock the straight rod 54 to the spindle 60.

Figure 7:
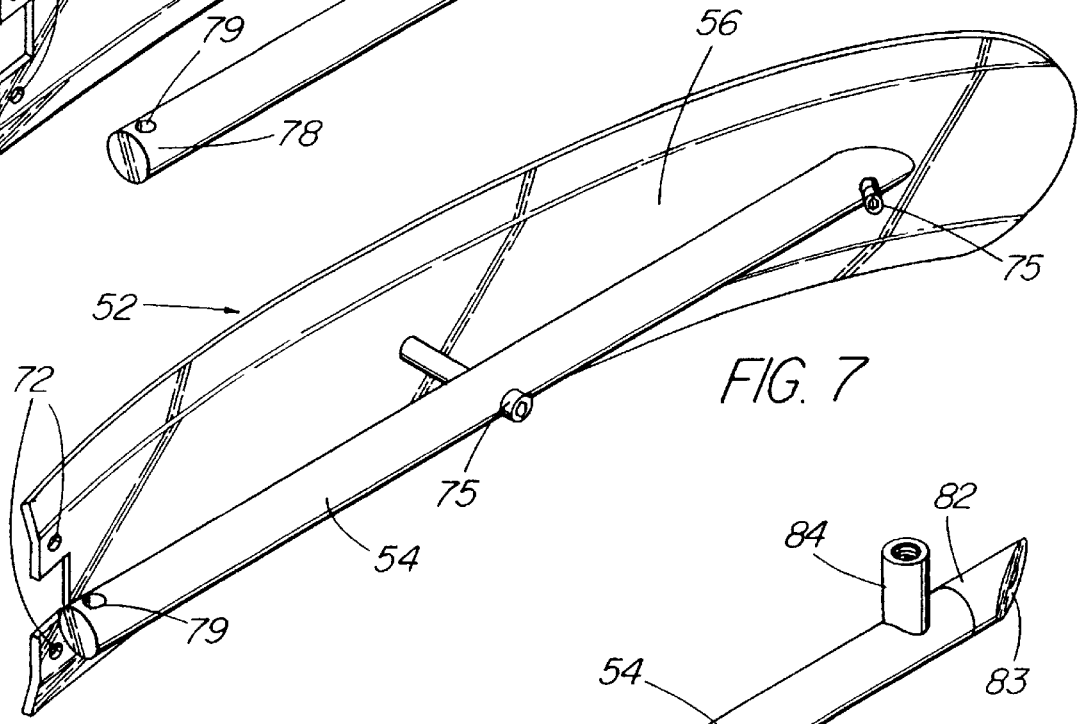
FIG. 7 is an isolated view of one of the arms.

As seen in FIG. 7, the straight rod 54, seen in FIG. 6, has been secured to the curved blade 56 by the fastening means 75 that extend through the hollow tubes 76 and 77. Considerable torque can be applied to the fastening means 75 without placing stress on the straight rod 54 or tending to collapse it since the pressure is borne by the tubes 76 and 77.

Figure 8:
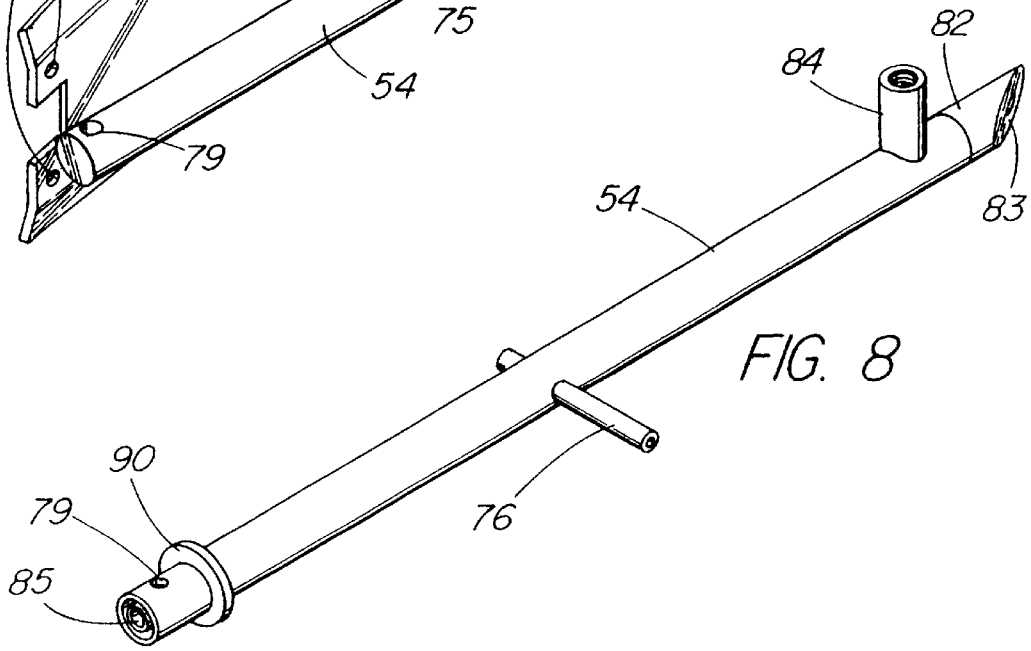
FIG. 8 is an isolated view of a straight rod on which a nozzle will be carried.

FIG. 8 is a perspective view of a straight rod 54 that will carry a nozzle 58. Since water under high pressure will flow through this straight rod 54, its free end has been plugged by welding a solid rod 82 to its free end. As previously stated, the free ends of the straight rods 54 are formed such that they fit flush against the concave surface of the associated curved blades 56. In this view, the formed surface is seen and has been identified as 83. In this version of the straight rod 54, the formed surface is formed on the solid rod 82. A short tube 84 is welded to the straight rod 54 adjacent its free end. Short tube 84 has internal threads formed therein for reception of the nozzle 58. The hollow tube 76 in this version of the straight rod 54 is identical, as is the straight rod that does not carry a nozzle. The central end of this straight rod 54 includes a hole 79 for receiving a set screw 59. There is shown in this view an annular rubber seal 90 that is placed in the bore 65 that receives the straight rods through which high pressure water is dispersed. The end of the straight rod is then inserted into the bore 65 and secured by a set screw 59 from the bottom of the spindle 60. This design allows a damaged straight rod 54 to be replaced without removing the spindle 60. The seal 90 can withstand pressures up to 4,000 psi. A tube 85 extends transverse to the longitudinal axis of straight rod 54 at the hole 79 to prevent the loss of water through hole 79 and to prevent the stressing of the straight rod 54.

The curved blades 56 of the rotating pick-up member 50 create a tremendous updraft that recovers the water that has been dispensed through the nozzles 58, as well as any debris from the surface to be cleaned. This retrieved material moves outwardly as a result of the centrifugal force acting upon it. As the retrieved material reaches the outer free ends of the curved blades 56, it is confined to the annular channel formed along the periphery of housing 40. The free ends of curved blades 56 are shaped to closely follow the shape of the annular channel 43. The retrieved material is retained by the leading surface of the curved blades 56 and the annular channel 43. When the retained material reaches the discharge 41, it exits the housing 40. The discharge 41 is connected by a conduit to the pump 17 which provides the necessary power to quickly discharge the retrieved material from the housing and to eliminate resistance to retrieved material exiting the housing.

A second embodiment of Applicants' power wash and reclamation machine is shown in FIGS. 9 through 19. This embodiment is similar to the first embodiment disclosed in FIGS. 1 through 8 but has several important improvements over the first embodiment. In this embodiment, all welding has been eliminated in the assembly of the rotating pick-up member. As a result, when it is necessary to repair or rebuild the rotor, only the damaged part must be replaced and, thus, most of the replacement parts are nuts and bolts. Since all nuts and bolts used in the assembly are standard off the shelf items, this has reduced the cost of repair and rebuilding considerable. This has also reduced the required hardware inventory by over 60%.

Another significant improvement of the second embodiment over the first embodiment is the provision of a perforated disk to the bottom of the rotor. The perforated disk was initially applied to the bottom of the rotor to prevent debris such as nuts, bolts and sewer and manhole covers from being sucked up into the machine and destroying the rotating blades and bars. However, it was discovered that as a result of securing the free ends of the blade-bar assemblies to the disc, that the structural integrity of the entire rotor assembly has been greatly improved. However, an even more important and completely unexpected result has been discovered as a result of securing the perforated disc to the bottom of the rotor. The rotating blades force material out the discharge outlet and create a vacuum which causes water and debris to be lifted from the ground surface, spun around and discharged through the discharge outlet. Without the disc, some of the water and debris bounced back or fell as a result of gravity before it reached the discharge outlet. As a result, without the disc, less than all of the liquid and debris that was initially picked up was actually discharged. The liquid and debris that fell back to the surface being cleaned would be picked up a second or third time and would eventually be discharged. Applicants have found that, with the disc, the liquid and debris carried by the liquid flows along the upper surface of the disc bridging and detouring around the apertures formed in the disc and the efficiency of the power wash and reclamation machine has been significantly increased.

There is shown in FIG. 9 a cross-section view of the second embodiment of Applicants' power wash and reclamation machine. A generally disc-shaped housing 140, similar to housing 40 in the first embodiment, is carried by and extends downwardly from the channel or frame members as is disclosed in the first embodiment. A spindle 160, similar but not identical to spindle 60 of the first embodiment, is supported for rotation on housing 140 by a bearing 142. A rotor having eight arms 152 each comprised of a curved blade 156 and a straight rod 154 is disclosed, however the specific number of arms could be greater or less than eight. The curved blades 156 are essentially the same as curved blade 56 illustrated in FIG. 6 except that the central aperture has been eliminated. In this embodiment, two of the arms 152 carry nozzles 158 at their outer extremity for dispensing liquid to the surface to be cleaned. In FIG. 9, the two arms 152 that carry nozzles 158 are seen. The curved blades 156 are not shown in FIG. 9 but are shown in FIG. 11. A central bore 162, through which liquid flows to the nozzles 158, is formed in spindle 160. Each of the arms 152 has a stand-off member 153 secured thereto. The stand-off members 153 extend downward and are tapped at 155 to receive bolts for securing the disc 175 to the rods 154.

As best seen in FIG. 11, a plurality of tapped holes 176 are formed in the bottom surface of the spindle and function to receive bolts that mount the disc 175 to the spindle.

Figure 10:
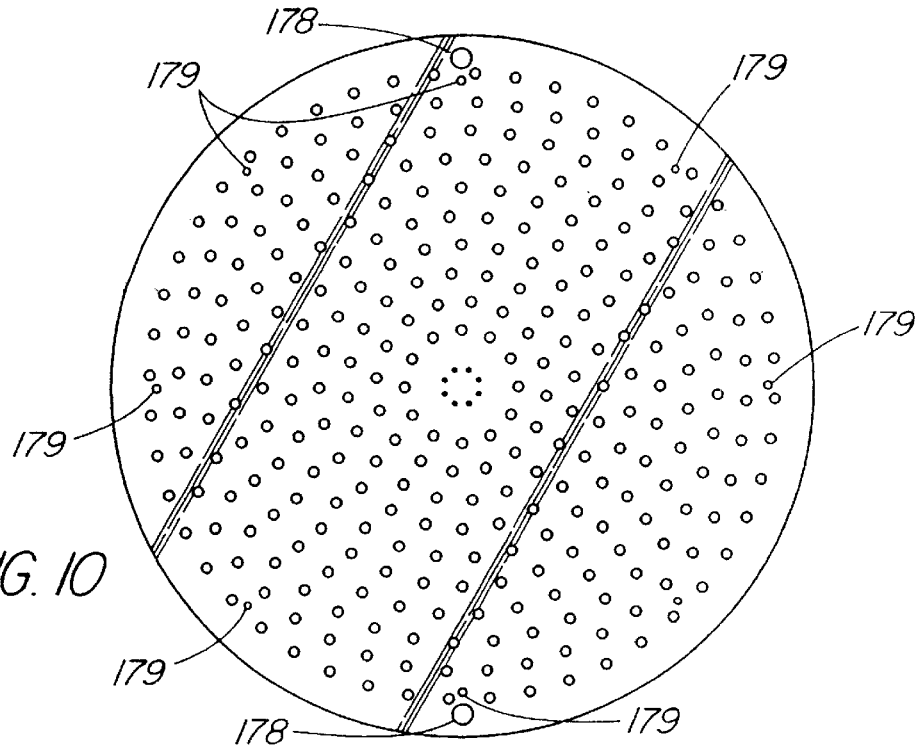
FIG. 10 is a bottom view of a perforated disc used in the second embodiment of the power wash and reclamation machine.
Figure 13:
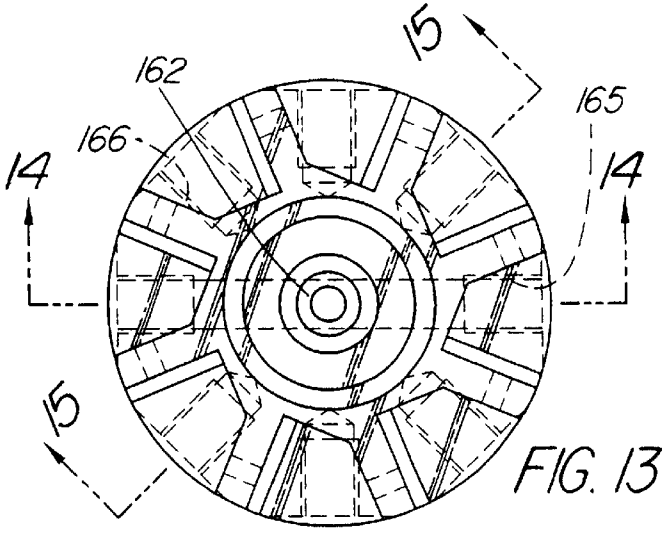
FIG. 13 is a top view of the spindle shown in FIG. 11.

The un-mounted disc 175 is shown in FIG. 10. In addition to the pattern of perforations 177 formed in disc 175, there are two openings 178 through which the nozzles 158 dispense liquid and an elongated or slotted opening 179 for each of the arms 152. To assemble the disc 175 on the rotor, dowels can be placed in the tapped holes 155 and 176 for aligning the disc with the spindle 160 and straight rods 154. As the dowels are removed, they are replaced with bolts which secure the disc 175 to the bottom surface of the rotor. In the preferred embodiment of Applicants' machine, this disc has a diameter of 34.625 inches. However, it should be understood that this dimension is not critical to Applicants' invention, and machines designed to use discs of greater or lesser diameter can be built without departing from Applicants' invention. The pattern of perforations 177 is formed to provide an approximate equal spacing between openings over the surface of the disc. There are over 300 perforations in the disc, and if the diameter of these openings is ½ inch, then the total open area of the disc is about 8% of the total area of the disc 175. When the diameter of the opening is increased to 1 inch, then the total open area of disc is about 30%.

The spindle 160 of the rotating pick-up member 150 is formed from stainless steel and is mounted for rotation in bearing 142 about its longitudinal axis centrally of the housing 140. Bearing 142 is carried by the housing 140. Spindle 160 is driven in the same manner as discussed for spindle 60.

Figure 15:
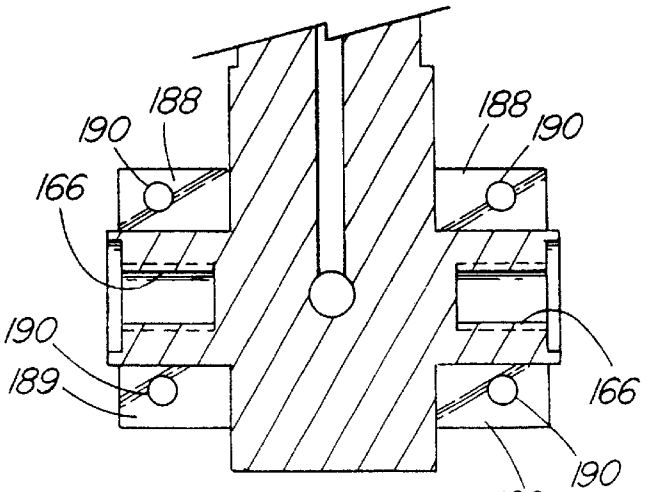
FIG. 15 is an enlarged cross sectional view of the hub portion of the spindle shown in FIG. 12 taken along lines 15—15 of FIG. 13.
Figure 14:
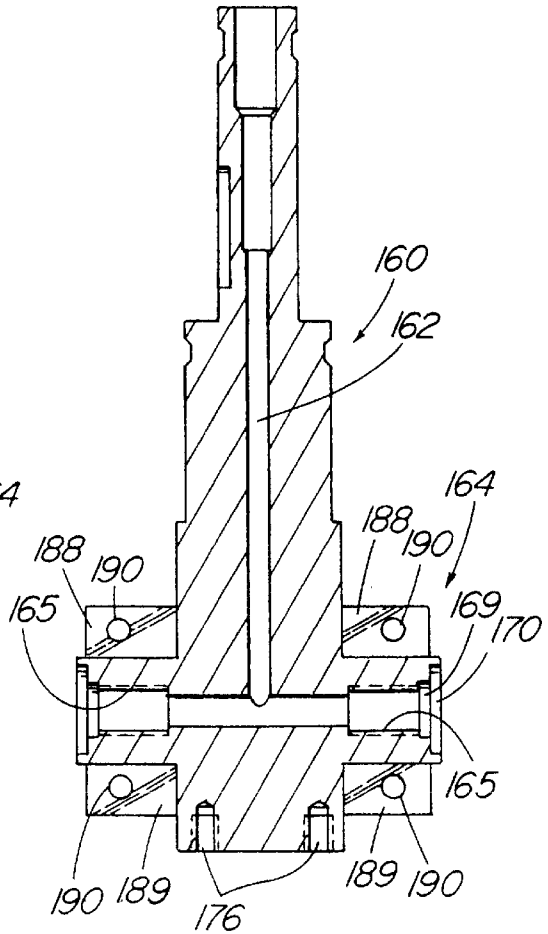
FIG. 14 is a cross-sectional view of the spindle shown in FIG. 11 taken along lines 14—14 of FIG. 13.
Figure 12:
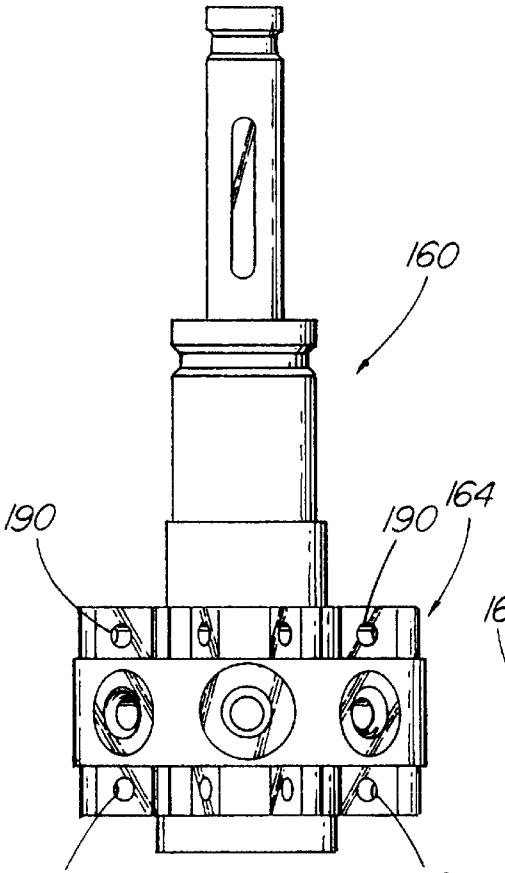
FIG. 12 is a front view of the isolated spindle for the second embodiment of the power wash and reclamation machine.

Referring now to FIGS. 12–15, the spindle 160 will be discussed. A longitudinally extending bore 162 is formed in the spindle extending from its upper driven end toward its lower portion along the spindle's longitudinal axis. This longitudinally extending bore 162 does not open through the bottom end of the spindle 160. The spindle includes a hub 164 that is located at the lower portion of the spindle 160 contained within the housing 140. There are a plurality of radially extending bores 165, 166 that are normal to the spindle's longitudinal axis formed in the hub 164. As best seen in FIG. 14, a cross-sectional view of the spindle, taken along lines 14—14 of FIG. 13, some of the radially extending bores 165, intersect with and communicate with the longitudinally extending bore 162. Also, as best seen in FIG. 15, the remainder of the radially extending bores 166 stop short of the longitudinally extending bore 162 and, thus, there is no fluid communication between these bores 166 and longitudinally extending bore 162. The straight rods 154 that carry the nozzles 158 are inserted into the bores 165 such that the hollow rods 154 are in fluid communication with a central bore 162 formed in the spindle 160. As a result, water under high pressure flows through bore 162 into the hollow straight rods 154 and is discharged through the nozzles 158. The radially extending bores 165 and 166 are provided with internal threads for the reception of rods 154 that have complementary threads.

The spindle 160 has upper flange 188 and a lower flange 189 for each of the arms 152. As shall be further discussed, fastening means 174, such as nuts and bolts, secure the curved blades 156 to the hub 164 of the spindle 160 through holes 190 formed in flanges 188 and 189.

Referring now to FIGS. 16 through 19, the rods 154 and the mechanisms for securing them to the spindle 160 will be discussed.

Figure 16:
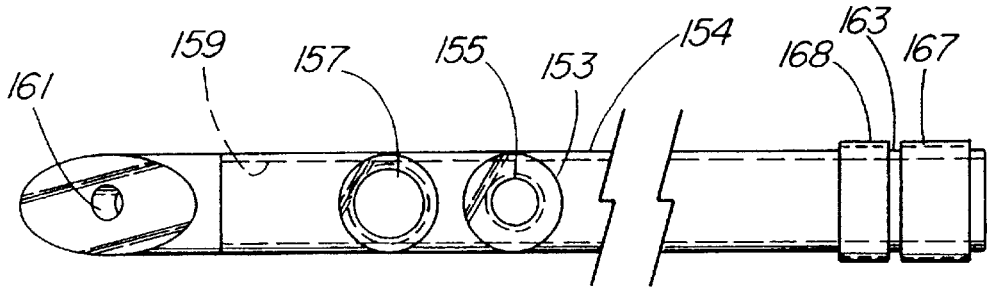
FIG. 16 is a bottom view of a spray bar that is used in the second embodiment of the power wash and reclamation machine.
Figure 17:
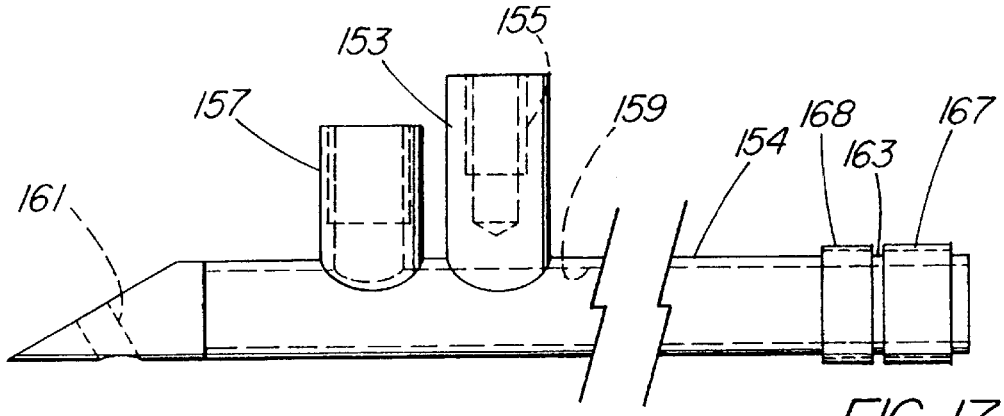
FIG. 17 is a side view of the spray bar seen in FIG. 16.

FIG. 16 is a bottom view and FIG. 17 is a side view of a spray bar which is one of the straight rods 154 that carries a nozzle 158. The straight rod 154 is hollow, as indicated at 159, and includes a solid metal plug 151 that closes the left-hand end, as seen in FIGS. 16 and 17. A hollow tube 157 is secured to straight rod 154 over the hollow portion 159 adjacent to the solid metal plug 151. A hole is drilled in the straight rod 154 to provide fluid communication between the hollow tube 157 and the hollow 159 of the straight rod 154. The free end of the hollow tube 157 is tapped to receive the nozzle or jet 158. The free end of plug 151 is machined at an angle of about 60° to form a surface that will fit flush along the trailing surface of a curved blade 156. An aperture 161 is formed through this surface that will receive a fastening mechanism, such as a nut and bolt, for connecting the free end of the curved blade 156 to the straight rod 154. The end of straight rod 154 that is secured to the hub 164 is provided with a first machine threaded portion 167 that will mesh with the threads formed in the radially extending bores 165. A second machine threaded portion 168 is formed on the straight rod 154 that is spaced from the first machine threaded portion 167 by a groove 163. As best seen in FIG. 14, a radius groove 169 and a flat seat 170 are machined in the hub 164 at the opening of the radially extending bores 165.

The following process is followed to secure a spray bar 154 and associated curved blade 156 to the hub 164. The curved blade 156 is secured to the upper and lower flanges 188 and 189 by fasteners such as nuts and bolts that extend through apertures 72 in the blade and holes 190 formed in flanges 188 and 189. A jam nut 171, (see FIG. 9) is threaded over the first and second threaded portions 167 and 168 all the way to the end of the second threaded portion 168. Then a flat washer is placed over the threaded end of the spray bar 154 such that it is up against the jam nut 171. Then an O-ring is rolled on to the threaded end of the spray bar until it sits in the groove 163. The spray bar 154 is then threaded into the radially extending bore 165 as far as it will go and is then backed off a small amount. This causes the O-ring to sit in the radius groove 169 and the flat washer to be flush with the flat seat 170. The free end of the curved blade 156 is then secured to the free end of the spray bar 154 by fasteners that extend through the free end aperture 74 in the blade 156 and the aperture 161 formed in the plug 151. The jam nut 171 that had been backed off is now tightened which functions to compress the O-ring in the radius groove 169 and lock the rod 154 to the hub 164. This connection forms a fluid seal that will prevent the high pressure fluid from leaking through the threaded connection of the rod 154 to the hub 164. Also when the spray bar is thus secured to the hub 164, the stand-off member 153 and the nozzle or jet 158 are properly located and will be aligned with the disc 175 when it is mounted.

Figure 18:
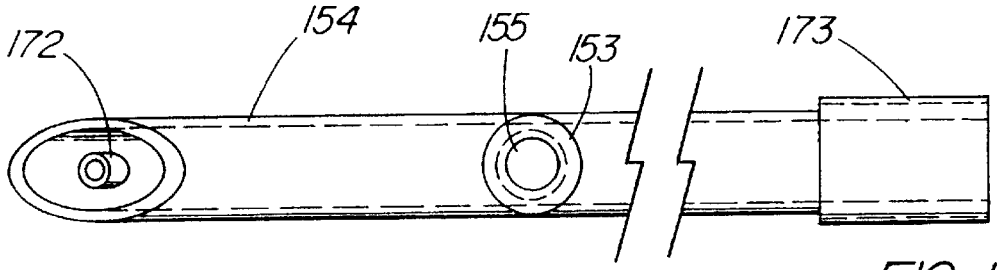
FIG. 18 is a bottom view of a non-spray bar that is used in the second embodiment of the power wash and reclamation machine.
Figure 19:
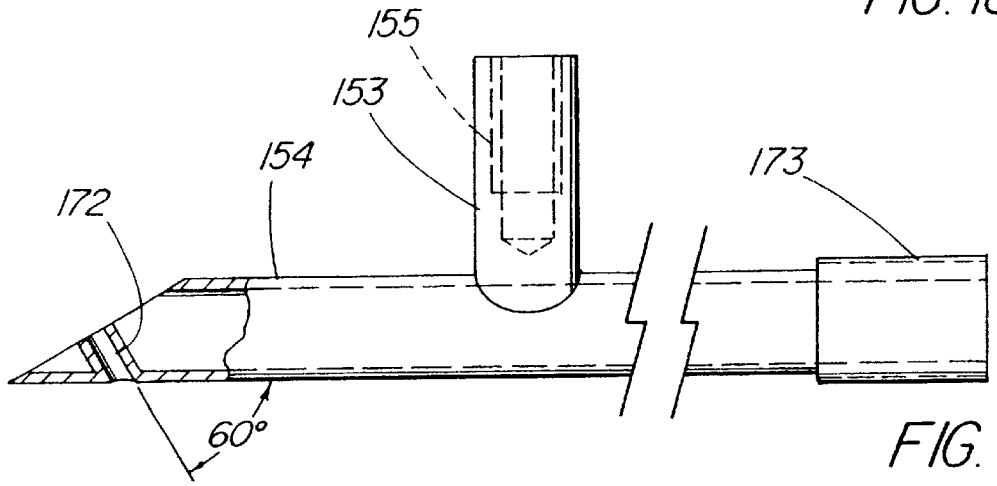
FIG. 19 is a side view of the non-spray bar shown in FIG. 18.

FIG. 18 is a bottom view and FIG. 19 is a side view of one of the straight rods 154 that does not carry a nozzle 158. Although this rod is shown as hollow, it could be made as a solid member. The rod is cut at an angle of about 60° at the left-hand end, as seen in FIGS. 16 and 17, so that this end will be flush with the following surface of its associated curved blade 156. Provided this rod is hollow, a short hollow tube 172 receives a fastening mechanism such as a nut and bolt for securing the free end of rod 154 to its associated curved blade 156. Without the hollow tube 172, this could collapse the end of the rod 154. A threaded portion 173 is provided at the end of straight rod 154 that is connected to the hub 164.

The same procedure is followed to secure a straight bar 154 that does not carry a nozzle or jet 158 and associated curved blade 156 to the hub 14 as for the bars that carry the nozzle or jet except that the O-ring is not used.

Figure 20:
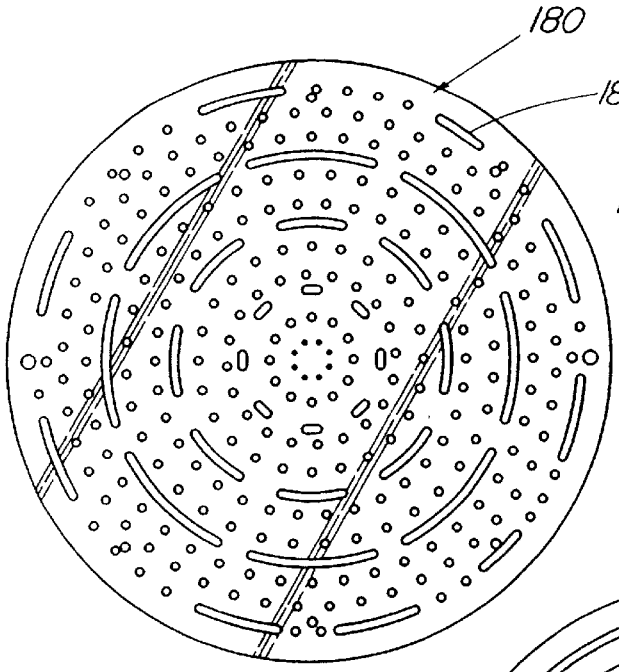
FIG. 20 is a bottom view of a second embodiment of a perforated disc used in the second embodiment of the power wash and reclamation machine.

Applicants' have found the results of using a disc having the perforation pattern 177 as illustrated in FIG. 10 to be excellent in most situations. However, they have found that in some situations, some of the perforations in this disc become plugged. In an effort to find other perforation patterns that may overcome this problem, Applicants have modified the pattern shown in FIG. 10. A first modification having a perforation pattern 180 is shown in FIG. 20. In this modification, some of the apertures within some of the concentric circles are expanded into elongated slots 181. The liquid that has been recovered through the perforations and slots travels in a generally radial direction toward the periphery of the disc and then to the discharge port 41. Since the slots 181 extend generally normal to the direction that the liquid travels, the liquid has sufficient momentum to span the width of the slots and not return to the surface being cleaned. When the apertures in this disc have a diameter of ½ inch and the slots have a width of ½ inch, the total open area of this disc is about 10% of the total surface area of the disc. If the diameter of the perforation and the width of the slots are increased to 1 inch, the open area of the disc would be about 34%.

Figure 21:
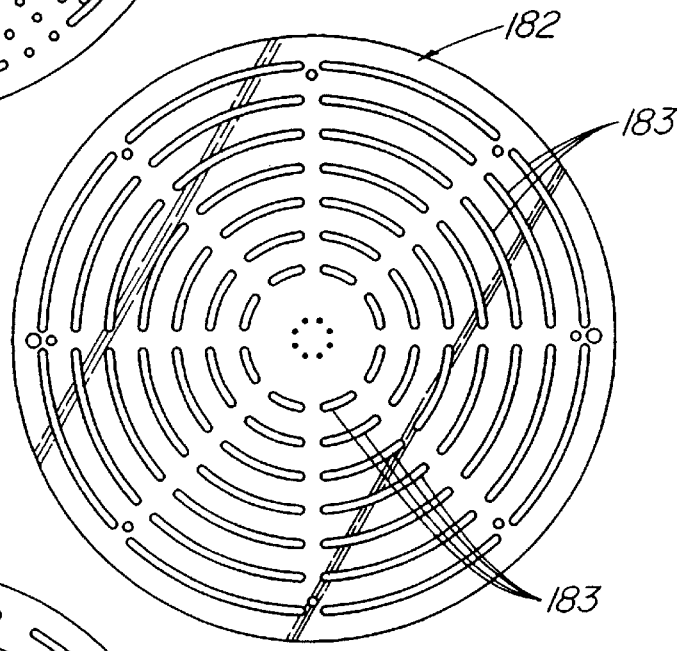
FIG. 21 is a bottom view of a third embodiment of a perforated disc used in the second embodiment of the power wash and reclamation machine.

Another disc embodiment having a perforation pattern 182 is shown in FIG. 21. In this pattern 182, there are seven concentric circles each of which is formed of eight slots 183. All of the slots 183 have a width of ½ inch. The slots 183 in the largest concentric circle are, of course, the longest, and the slots 183 become progressively smaller as you move to the smallest concentric circle. The total open area of this disc is about 25% of the total disc area.

Plugging was experienced in both the disc having ½ inch perforation and slots shown in FIG. 20 and FIG. 21 when cleaning crumb rubber from airport runways. It was found that the crumb rubber forms into spherical shapes having a diameter of about ½ inch. These spherical balls were found to wedge in both the ½ inch apertures and the ½ inch slots, thus plugging the openings.

Figure 22:
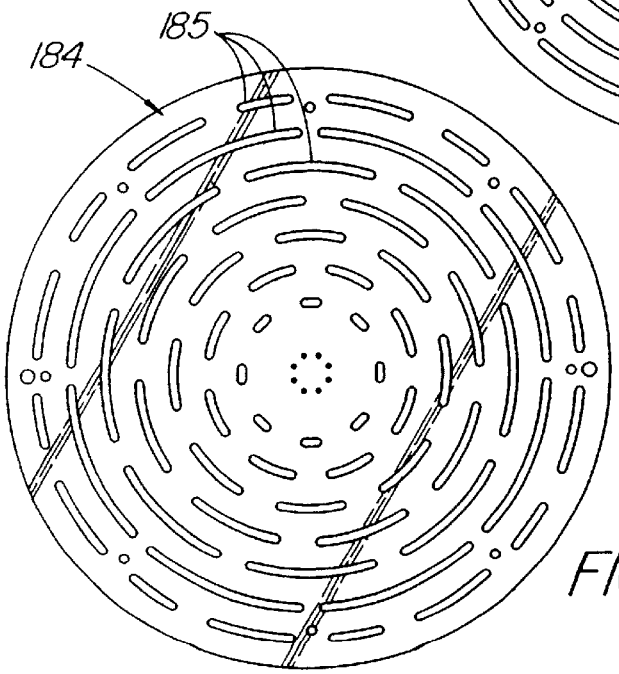
FIG. 22 is a bottom view of a fourth embodiment of a perforated disc used in the second embodiment of the power wash and reclamation machine.

A disc having the perforation pattern 184 in which all the slots 185 are 1 inch wide was developed and is shown in FIG. 22. This disc has seven concentric circles formed by slots 185 that are 1 inch in width and are of various lengths. The slots are arranged such that the recovered liquid that is traveling outwardly in a generally radial direction on the upper surface of the disc will rarely encounter a slot in all of the concentric circles. This perforation pattern 184 has provided excellent results particularly when cleaning runways of crumb rubber. The balls of crumb rubber were able to pass through these wider slots. This disc has a total open area of about 43% of the total disc. It has been found that the advantage of maintaining the water and debris that has been sucked up through the openings on the upper surface of the disc is retained with this disc having an open area in excess of 40%.

Discs with perforations greater than 1 inch are currently being fabricated that will have an open area in excess of 60%.

Figure 23:
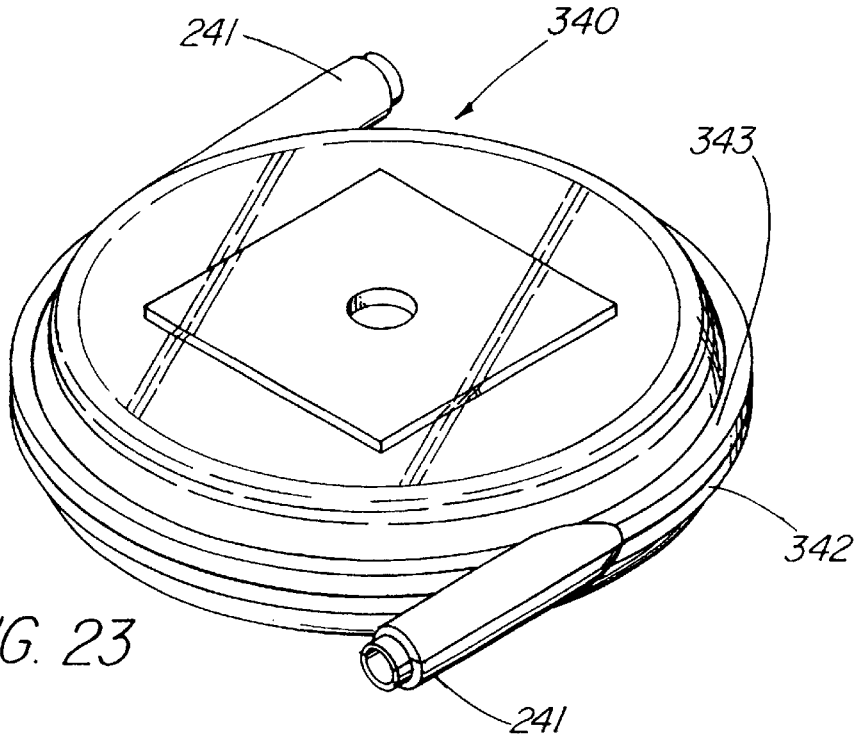
FIG. 23 is a top perspective view of a third embodiment of the invention in which the rotor and disc are a unitary casting.

FIG. 23 is a top perspective view of the housing 340 for a third embodiment of Applicants' invention in which the rotor and disc are formed as a unitary casting 200. In this view, the housing 340 has two discharge ports 241. However, the housing 340 of this embodiment could have either a single or double discharge port. The double port feature illustrated in this view could also be utilized in the first or second embodiment.

Figure 24:
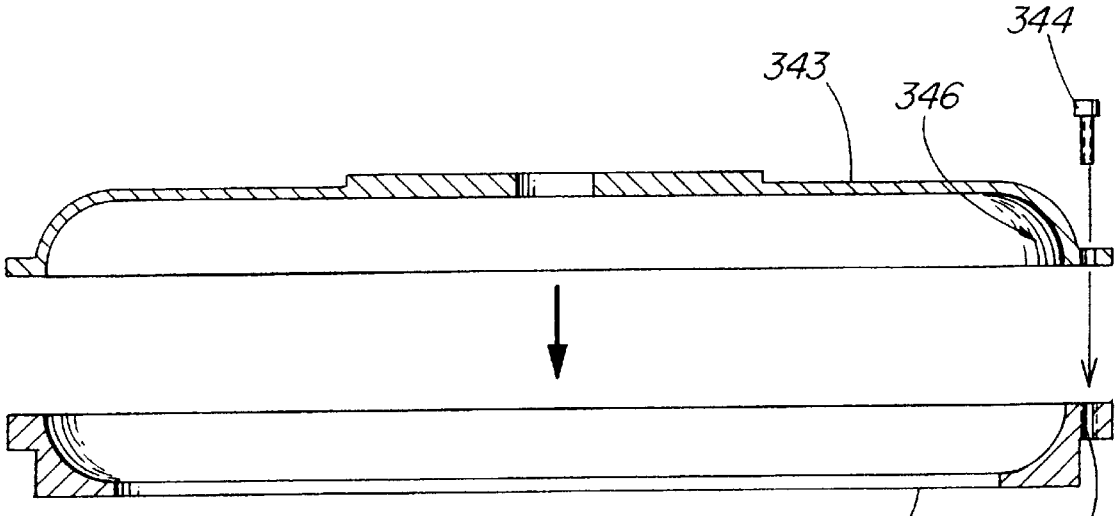
FIG. 24 is a cross-sectional view of the housing shown in FIG. 23 with the upper and lower halves of the housing separated from each other.

As best seen in FIG. 24, housing 340 includes two parts that are separated along a horizontal plane to allow the lower half 342 to be separated from the upper half 343. In this view, the lower half 342 has been separated from the upper half to better illustrate how the lower half 342 can be removed. Fastening mechanisms, which can be in the form of several sets of tapped holes 345 formed in the lower half 342 that receive threaded bolts 344 that are rotatably carried in apertures formed in the upper half 343, are provided to allow the lower half 342 to be secured to and removed from the upper half 343. When the halves 342 and 343 are secured together, they provide an annular channel 346 along their periphery. It is necessary to remove the lower half 342 to remove and replace the unitary cast rotor and disc 200 because the rounded ends of the curved blades 204 extend into the annular channel 346.

Figure 25:
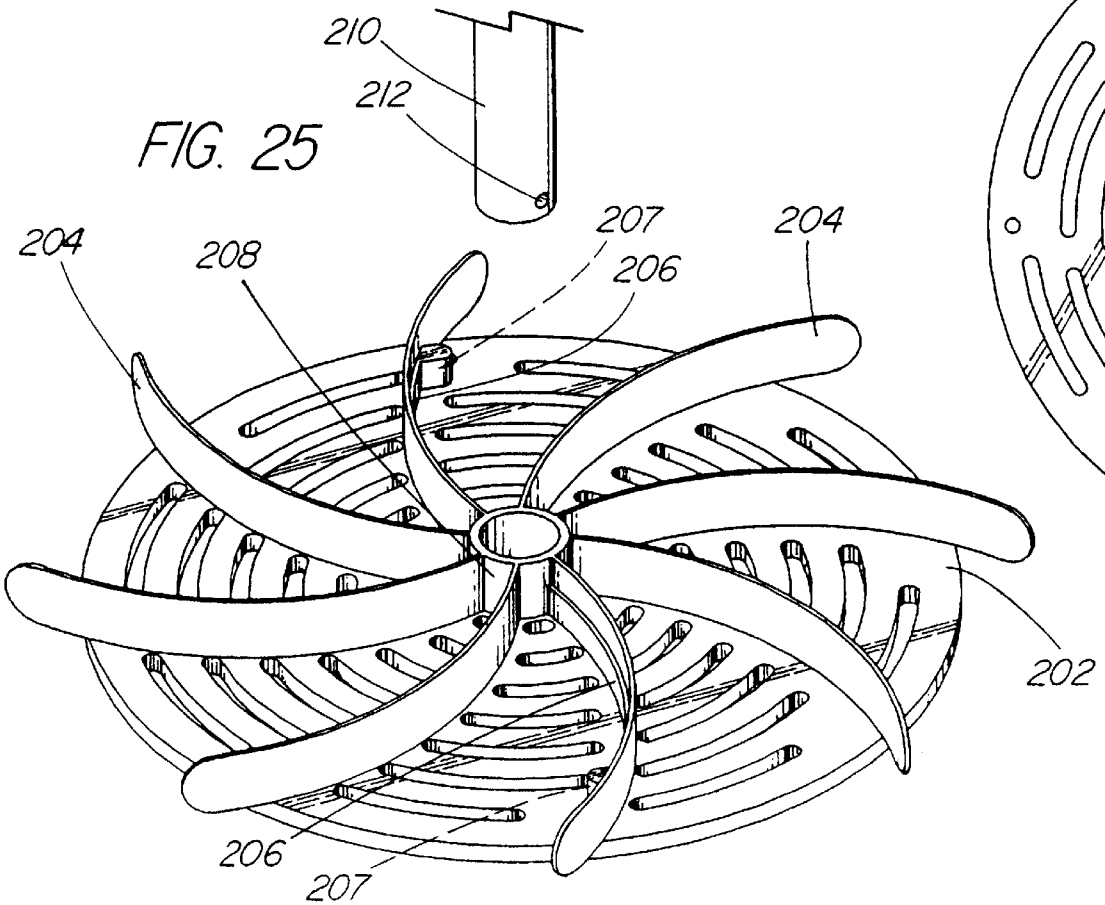
FIG. 25 is a top perspective view of the unitary casting that includes the rotor and disc for the third embodiment.

FIG. 25 is a top perspective view of the unitary casting 200 that includes both curved blades 204 and a flat perforated disc portion for the third embodiment shown in FIGS. 23 and 24. In this embodiment, the element previously referred to as the hub portion of the spindle is now cast as an integral part 208 of the curved blades 204 and the perforated disc 202. The straight bars 54, 154 that were elements of the first and second embodiments have been eliminated. The elimination of the straight bars 54, 154 is possible as a result of the additional structural strength that has been provided to the curved blades as a result of their being integral with the perforated disc and the hub portion 208. This casting could be aluminum, a polymeric material or ferrous metal. The combined cast rotor and disc 200 includes a perforated disc portion 202, a plurality of curved blades 204, two generally radial extending water conduits 206 that communicate with a source of water under pressure in the hub portion 208. The free ends of the water conduits 206 have openings 207 that receive nozzles or jets that function to direct the water toward the surface to be cleaned. The hub portion 208 is mounted on a driven spindle 210. As in the previous embodiments, the driven spindle 210 is driven by a power mechanism such as the engine 11 seen in FIG. 1A. The driven spindle 210 has a downwardly extending bore through which high pressure water that can be at an elevated temperature flows through radial openings 212 formed in the driven spindle 210 that are aligned with the generally radial extending water conduits 206.

This embodiment provides a mechanism that can be quickly and expediently repaired in the field by simply removing and replacing the unitary cast rotor and disc 200.

Figure 26:
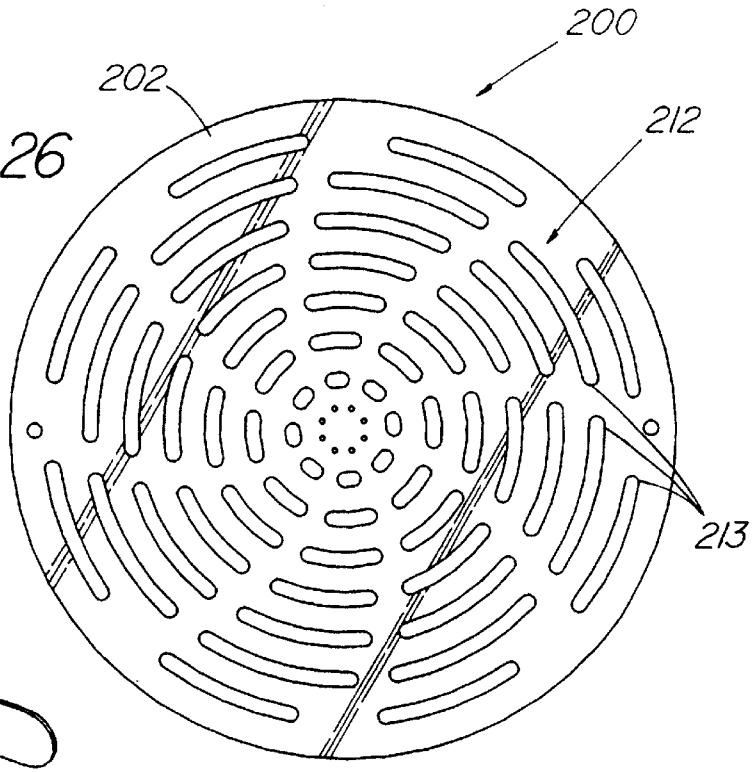
FIG. 26 is a bottom view of the disc portion of the unitary casting seen in FIG. 25.

A special perforation pattern 212 has been developed for this combined cast rotor and disc 200 in which there are no perforations in the portions of the disc where the curved blades extend from the disc. This pattern is shown in FIG. 25, as well as in the bottom view FIG. 26 of this disc portion. When the slots 213 for this disc are 1 inch wide, this disc has an open area of about 34%.

The foregoing description of a preferred embodiment and the best mode of the invention known to Applicants at the time of filing this application has been presented for the purpose of illustration and description. It is not intended to be exhaustive or to limit the invention to the precise form disclosed and obviously many modifications and variations are possible in the light of the above teachings. These embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims that are appended hereto.

What is claimed is:

1. In a method of assembling a cleaning device including a cyclonic power unit having a rotating member in combination with a stationary unit wherein the improvement comprises the steps of:

providing a receiving facility on said stationary unit, connecting the cyclonic power unit to said receiving facility by at least one flexible conduit;

providing the cyclonic power unit with a frame that is maneuvered over a flat surface;

mounting a generally disc-shaped housing on said frame;

providing said generally disc-shaped housing with an annular channel at its periphery;

mounting a spindle having a longitudinal axis and a hub portion on said disc-shaped housing for rotation about the spindle's longitudinal axis such that said hub portion is aligned with said annular channel;

providing a power mechanism for rotating said spindle about said longitudinal axis;

securing a plurality of straight rods to said spindle such that they extend normal to said longitudinal axis and terminate in free ends;

providing an associated curved blade, having ends and a convex and a concave surface, for each straight rod:

connecting one end of each curved blade to said spindle such that its convex surface is the leading surface as the spindle is rotated;

connecting the other end of each curved blade to said free end of its associated straight rod such that the free end of each curved blade extends into said annular channel;

providing a discharge outlet in said annular channel through which matter picked up from said flat surface is transmitted through said flexible conduit to said receiving facility.

2. In the method of assembling a cleaning device as recited in claim 1 wherein the improvement further comprises the step of:

providing a support to each curved blade extending from a mid-portion of each curved blade to its corresponding straight rod.

3. In the method of assembling a cleaning device as recited in claim 2 wherein the improvement further comprises the step of:

securing a perforated disc to the spindle and to the straight rods such that matter picked up from the flat surface must pass upwardly through perforations of the perforated disc before it is discharged through said discharge outlet.

4. In the method of assembling a cleaning device as recited in claim 1 wherein the improvement further comprises the step of:

securing a perforated disc to the spindle and to the straight rods such that matter picked up from the flat surface must pass upwardly through perforations of the perforated disc before it is discharged through said discharge outlet.

5. In the method of assembling a cleaning device as recited in claim 1 wherein the step of securing a plurality of straight rods to said spindle comprises the further steps of:

providing a tapped bore, extending normal to said longitudinal axis, in said hub portion for each straight rod;

providing threads on an end of each straight rod for securing them to the spindle;

connecting each straight rod to the hub portion by screwing the threaded ends of the straight rods into the tapped bores in the hub portion.

6. In the method of assembling a cleaning device as recited in claim 5 wherein the step of securing a plurality of straight rods to said spindle comprises the further step of:

locking the straight rods in the tapped bores by threading a jam nut on the threads of the straight rods until it locks the straight rod to the hub portion.

7. In the method of assembling a cleaning device as recited in claim 5 wherein the step of connecting the other end of each curved blade to said free end of its associated straight rod comprises the further steps of:

shaping the free ends of the straight rods such that they lay flush against the concave surface of the curved blades; and securing the shaped free ends of the straight rods flush against the concave surface of the curved blades with releasable fasteners.

8. In the method of assembling a cleaning device as recited in claim 6 wherein the step of connecting the other end of each curved blade to said free end of its associated straight rod comprises the further steps of:

shaping the free ends of the straight rods such that they lay flush against the concave surface of the curved blades; and securing the shaped free ends of the straight rods flush against the concave surface of the curved blades with releasable fasteners.

9. In the method of assembling a cleaning device as recited in claim 1 wherein the step of connecting the other end of each curved blade to said free end of its associated straight rod comprises the further steps of:

shaping the free ends of the straight rods such that they lay flush against the concave surface of the curved blades; and securing the shaped free ends of the straight rods flush against the concave surface of the curved blades with releasable fasteners.

10. In a method of assembling a cleaning device including a cyclonic power unit having a rotating member in combination with a stationary unit wherein the improvement comprises the steps of:

providing a recycling facility on said stationary unit;

providing a clean water storage facility on said stationary unit;

providing liquid transfer mechanism for transferring recycled liquid from said recycling facility to said clean water storage facility;

providing a clean water pump for increasing the pressure of water flowing from said water storage facility;

connecting the cyclonic power unit to said recycling facility and to said clean water pump by separate flexible conduits;

providing the cyclonic power unit with a frame that is maneuvered over a flat surface;

mounting a generally disc-shaped housing on said frame;

providing a water dispensing mechanism on said cyclonic power unit for jetting water against the flat surface to be cleaned in the area below said generally disc-shaped housing;

providing said generally disc-shaped housing with an annular channel at its periphery;

mounting a spindle having a longitudinal axis and a hub portion, on said disc-shaped housing for rotation about the spindle's longitudinal axis such that said hub portion is aligned with said annular channel;

providing power mechanism for rotating said spindle about said longitudinal axis;

securing a plurality of straight rods to said spindle such that they extend normal to said longitudinal axis and terminate in free ends;

providing an associated curved blade, having ends and a convex and a concave surface, for each straight rod:

connecting one end of each curved blade to said spindle such that said convex surface of the curved blade is the leading surface as the spindle is rotated;

connecting the other end of each curved blade to said free end of its associated straight rod such that the free end of each curved blade extends into said annular channel;

providing a discharge outlet in said annular channel through which water and contamination picked up from said flat surface is transmitted through said flexible conduit that is connected to said recycling facility.

11. In the method of assembling a cleaning device as recited in claim 10 wherein the improvement further comprises the step of:

providing a support to each curved blade extending from a mid-portion of each curved blade to its corresponding straight rod.

12. In the method of assembling a cleaning device as recited in claim 11 wherein the improvement further comprises the step of:

securing a perforated disc to the spindle and to the straight rods such that matter picked up from the flat surface must pass upwardly through perforations of the perforated disc before it is discharged through said discharge outlet.

13. In the method of assembling a cleaning device as recited in claim 10 wherein the improvement further comprises the step of:

securing a perforated disc to the spindle and to the straight rods such that matter picked up from the flat surface must pass upwardly through perforations of the perforated disc before it is discharged through said discharge outlet.

14. In the methods as recited in claims 4 or 13 wherein the improvement further comprises the step of:

providing perforations in said perforated disc such that from about 7 to about 40 percent of the disc has perforations.

15. In the methods as recited in claims 4 or 13 wherein the improvement further comprises the step of:

providing perforations in said perforated disc that are circular.

16. In the methods as recited in claims 4 or 13 wherein the improvement further comprises the step of:

providing perforations in said perforated disc that are circular and have diameters of about ½ to about 1 inch.

17. In the methods as recited in claims 4 or 13 wherein the improvement further comprises the step of:

providing perforations in said perforated disc that are slots formed along circles that are concentric to said disc.

18. In the methods as recited in claims 4 or 13 wherein the improvement further comprises the step of:

providing perforations in said perforated disc that are slots, having widths of about ½ to about 1 inch, formed along circles that are concentric to said disc.

19. In the method of assembling a cleaning device as recited in claim 10 wherein the step of securing a plurality of straight rods to said spindle comprises the further steps of:

providing a tapped bore, extending normal to said longitudinal axis, in said hub portion for each straight rod;

providing threads on an end of each straight rod for securing them to the spindle;

connecting each straight rod to the hub portion by screwing the threaded ends of the straight rods into the tapped bores in the hub portion.

20. In the method of assembling a cleaning device as recited in claim 19 wherein the step of securing a plurality of straight rods to said spindle comprises the further step of:

locking the straight rods in the tapped bores by threading a jam nut on the threads of the straight rods until it locks the rod to the hub portion.

21. In the method of assembling a cleaning device as recited in claim 19 wherein the step of connecting the other end of each curved blade to said free end of its associated straight rod comprises the further steps of:

shaping the free ends of the straight rods such that they lay flush against the concave surface of the curved blades; and securing the shaped free ends of the straight rods flush against the concave surface of the curved blades with releasable fasteners.

22. In the method of assembling a cleaning device as recited in claim 20 wherein the step of connecting the other end of each curved blade to said free end of its associated straight rod comprises the further steps of:

shaping the free ends of the straight rods such that they lay flush against the concave surface of the curved blades; and securing the shaped free ends of the straight rods flush against the concave surface of the curved blades with releasable fasteners.

23. In the method of assembling a cleaning device as recited in claim 10 wherein the step of connecting the other end of each curved blade to said free end of its associated straight rod comprises the further steps of:

shaping the free ends of the straight rods such that they lay flush against the concave surface of the curved blades; and securing the shaped free ends of the straight rods flush against the concave surface of the curved blades with releasable fasteners.

24. A device for cleaning flat surfaces including a maneuverable cyclonic power unit having a rotating member in combination with a stationary unit comprising:

a receiving facility carried by said stationary unit;

a flexible conduit connecting the cyclonic power unit to said receiving facility;

a frame for said cyclonic power unit that is maneuvered over the flat surface to be cleaned;

a generally disc-shaped housing mounted on said frame;

said generally disc-shaped housing having an annular channel along its periphery;

a spindle, having a longitudinal axis and a hub portion, said spindle mounted on said disc-shaped housing for rotation about the spindle's longitudinal axis such that said hub portion is aligned with said annular channel;

a power mechanism, supported by said frame, for rotating said spindle about said longitudinal axis;

a plurality of straight rods secured to said spindle such that they extend normal to said longitudinal axis and terminating in free ends;

an elongated curved blade having ends and concave and convex surfaces associated with each straight rod:

one end of each elongated curved blade connected to said spindle such that its convex surface is the leading surface as the spindle is rotated;

the other end of each elongated curved blade connected to said free end of its associated straight rod such that the free end of each curved blade extends into said annular channel;

a discharge outlet in said annular channel through which matter picked up from said flat surface is transmitted through said flexible conduit to said receiving facility.

25. A device for cleaning flat surfaces as set forth in claim 24 further comprising:

a support for each elongated curved blade extending from a mid-portion of each elongated curved blade to a mid-portion of its corresponding straight rod.

26. A device for cleaning flat surfaces as set forth in claim 25 further comprising:

a perforated disc secured to said spindle and to said straight rods such that matter picked up from the flat surface to be cleaned must pass upwardly through perforations of the perforated disc before it is discharged through said discharge outlet.

27. A device for cleaning flat surfaces as set forth in claim 24 further comprising:

a perforated disc secured to said spindle and to said straight rods such that matter picked up from the flat surface to be cleaned must pass upwardly through perforations of the perforated disc before it is discharged through said discharge outlet.

28. In the device for cleaning flat surfaces as recited in claim 27 wherein the improvement further comprises:

said perforated disc including perforations such that from about 7 to about 40 percent of the disc has perforations.

29. In the device for cleaning flat surfaces as recited in claim 27 wherein the improvement further comprises:

said perforated disc having circular perforations.

30. In the device for cleaning flat surfaces as recited in claim 27 wherein the improvement further comprises:

said perforated disc having circular perforations that have diameters of about ½ to about 1 inch.

31. In the device for cleaning flat surfaces as recited in claim 27 wherein the improvement further comprises:

said perforated disc having slotted perforations that are formed along circles that are concentric to said disc.

32. In the device for cleaning flat surfaces as recited in claim 27 wherein the improvement further comprises:

said perforated disc having slotted perforations that have a width of about ½ to about 1 inch, formed along circles that are concentric to said disc.

33. A device for cleaning flat surfaces as set forth in claim 24 further comprising:

a tapped bore formed in said hub portion for each straight rod, said tapped bores extending normal to said longitudinal axis;

threads formed on an end of each straight rod for connecting each straight rod to the hub portion of said spindle.

34. A device for cleaning flat surfaces as set forth in claim 33 further comprising:

a jam nut threaded on the threads of each straight rods for locking the straight rods to said hub portion.

35. A device for cleaning flat surfaces as set forth in claim 33 further comprising:

the free ends of each straight rod that is connected to said elongated curved blade being shaped to lay flush against the concave surface of the curved blades; and the shaped free ends of the straight rods secured against the concave surface of the curved blades with releasable fasteners.

36. A device for cleaning flat surfaces as set forth in claim 34 further comprising:

the free ends of each straight rod that is connected to said elongated curved blade being shaped to lay flush against the concave surface of the curved blades; and the shaped free ends of the straight rods secured against the concave surface of the curved blades with releasable fasteners.

37. A device for cleaning flat surfaces as set forth in claim 24 further comprising:

the free ends of each straight rod that is connected to said elongated curved blade being shaped to lay flush against the concave surface of the curved blades; and the shaped free ends of the straight rods secured against the concave surface of the curved blades with releasable fasteners.

38. A device as set forth in claim 24 further including:

said generally dish-shaped housing having an edge; and a brush seal secured to said generally disc-shaped housing along said edge.

39. In a method of cleaning matter from flat surfaces using a maneuverable cyclonic power wash unit that has a rotating member that sprays pressurized water onto the surface to be cleaned, in combination with the components, including a water storage component in which a supply of water is stored to be used for cleaning, a water pump component that pumps and pressurizes water from the water storage component as it is directed to the cyclonic power wash unit and a filtering component that filters water containing debris wherein the improvement comprises the steps of:

providing a mobile platform, that is separate from said cyclonic power wash unit, for supporting said water storage component, water pump component and filtering component;

providing said cyclonic power wash unit with a non-rotating water inlet;

connecting said water pump component to said non-rotating water inlet;

driving said rotating member to rotate at a speed of about 2,000 rpm;

providing said rotating member with blades that when rotated create an upwardly directed draft;

providing a rotary union that will permit the undiminished flow of said pressurized water from said non-rotating inlet to said rotating member, for sustained periods;

securing a perforated, disc to said rotating member such that water and debris picked up from the surface to be cleaned, by said upwardly directed draft, must pass through perforations formed in the disc;

picking up water and debris from the surface being cleaned by said upwardly directed draft of said rotating member;

discharging the water and debris that has passed through said perforated disc from said cyclonic power wash unit and directing it to said filtering component;

filtering the reclaimed water containing debris that has been recovered from the surface to be cleaned; and directing the filtered water from the filtering component back into the water storage component so that the water may be further used for cleaning by the cyclonic power wash unit.

40. In a method as set forth in claim 39 wherein the invention further comprises the step of:

providing a water heater component that is carried by said mobile platform;

heating the pressurized water in said water heater component before the water is directed to said cyclonic power wash unit.

* * * * *

UNITED STATES PATENT AND TRADEMARK OFFICE

CERTIFICATE OF CORRECTION

PATENT NO. : 6,514,354 B2
DATED : February 4, 2003
INVENTOR(S) : R.D. Rohrbacher et al.

It is certified that error appears in the above-identified patent and that said Letters Patent is hereby corrected as shown below:

Column 20,
Line 2, delete "dish-shaped" and substitute -- disc-shaped -- in its place.
Line 26, immediately after "perforated" delete "," (comma).

Signed and Sealed this

Ninth Day of September, 2003

JAMES E. ROGAN
*Director of the United States Patent and Trademark Office*